US010753084B2

(12) United States Patent
Pilz et al.

(10) Patent No.: US 10,753,084 B2
(45) **Date of Patent: *Aug. 25, 2020**

(54) FIRE-RATED JOINT COMPONENT AND WALL ASSEMBLY

(71) Applicant: CALIFORNIA EXPANDED METAL PRODUCTS COMPANY, City of Industry, CA (US)

(72) Inventors: Donald Anthony Pilz, Livermore, CA (US); Tyler Elliott, Costa Mesa, CA (US)

(73) Assignee: California Expanded Metal Products Company, City of Industry, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/534,881

(22) Filed: Aug. 7, 2019

(65) Prior Publication Data

US 2019/0360195 A1 Nov. 28, 2019

Related U.S. Application Data

(63) Continuation-in-part of application No. 16/103,693, filed on Aug. 14, 2018.

(Continued)

(51) Int. Cl.
*E04B 1/94* (2006.01)

(52) U.S. Cl.
CPC ..... *E04B 1/947* (2013.01); *E04B 1/948* (2013.01)

(58) Field of Classification Search
CPC ..... E04B 1/947; E04B 1/948; E04B 2/7457
See application file for complete search history.

(56) References Cited

U.S. PATENT DOCUMENTS 1,130,722 A * 3/1915 Fletcher ..... E04B 2/58 52/355
1,563,651 A * 12/1925 Pomerantz ..... E04F 13/045 52/348

(Continued)

FOREIGN PATENT DOCUMENTS

CA 2234347 10/1999
CA 2697295 12/2013

(Continued)

OTHER PUBLICATIONS

U.S. Appl. No. 15/469,370, filed Mar. 24, 2017.‡

(Continued)

*Primary Examiner* — James M Ference
(74) *Attorney, Agent, or Firm* — Knobbe Martens Olson & Bear LLP

(57) ABSTRACT

A fire-rated component for a fire-rated joint, such as a head-of-wall assembly, includes an elongate body having at least a first layer, which can be in the form of a polymer profile. A second layer can be or include a foil lining and a third layer can be or include an intumescent material. The elongate body, such as the first layer, defines an air gap. The foil lining and/or the intumescent material can be positioned within the air gap. A planar lower portion of the first layer of the elongate body is positioned between a header track and a wallboard in the fire-rated joint. A non-planar upper portion of the first layer of the elongate body is positioned at least partially within a deflection gap of the wall assembly and sealingly engages the ceiling.

22 Claims, 15 Drawing Sheets

Related U.S. Application Data

(60) Provisional application No. 62/688,945, filed on Jun. 22, 2018, provisional application No. 62/643,325, filed on Mar. 15, 2018, provisional application No. 62/850,925, filed on May 21, 2019.

(56) References Cited

U.S. PATENT DOCUMENTS 2,105,771 A * 1/1938 Holdsworth ..... E04B 2/825 52/290
2,218,426 A * 10/1940 Hurlbert, Jr. ..... E04B 2/7863 52/290
2,683,927 A * 7/1954 Maronek ..... B21D 5/01 29/521
2,733,786 A * 2/1956 Drake ..... A47B 96/1408 52/633
3,129,792 A * 4/1964 Gwynne ..... E04B 2/60 52/364
3,271,920 A * 9/1966 Downing, Jr. ..... E04B 2/7854 52/481.1
3,309,826 A * 3/1967 Zinn ..... E04B 2/7457 52/241
3,324,615 A * 6/1967 Zinn ..... E04B 2/7409 52/241
3,355,852 A * 12/1967 Lally ..... E04B 1/943 52/834
3,397,495 A * 8/1968 Thompson ..... E04B 2/825 52/241
3,481,090 A * 12/1969 Lizee ..... E04B 2/825 52/241
3,537,219 A * 11/1970 Navarre ..... E04B 2/7863 52/481.2
3,562,985 A 2/1971 Nicosia
3,566,559 A * 3/1971 Dickson ..... E04B 2/78 52/126.4
3,648,419 A 3/1972 Marks
3,707,819 A * 1/1973 Calhoun ..... E04B 5/04 52/319
3,730,477 A 5/1973 Wavrunek
3,744,199 A * 7/1973 Navarre ..... E04B 2/78 52/481.2
3,757,480 A * 9/1973 Young ..... E04B 2/7411 52/241
3,786,604 A * 1/1974 Kramer ..... E04B 1/6801 52/232
3,837,126 A * 9/1974 Voiturier ..... B32B 17/10055 52/1
3,839,839 A * 10/1974 Tillisch ..... E04B 2/74 52/846
3,908,328 A * 9/1975 Nelsson ..... E04B 2/825 52/769
3,921,346 A 11/1975 Sauer et al.
3,922,830 A 12/1975 Guarino et al.
3,934,066 A * 1/1976 Murch ..... E04B 1/94 442/221
3,935,681 A * 2/1976 Voiturier ..... B32B 17/10045 52/1
3,955,330 A * 5/1976 Wendt ..... E06B 5/164 52/211
3,964,214 A * 6/1976 Wendt ..... E06B 5/164 52/1
3,974,607 A * 8/1976 Balinski ..... E04B 1/941 52/232
3,976,825 A * 8/1976 Anderberg ..... H02G 3/22 174/151
4,011,704 A * 3/1977 O'Konski ..... E04C 3/07 52/481.1
4,103,463 A * 8/1978 Dixon ..... E04B 2/824 52/126.4
4,130,972 A * 12/1978 Varlonga ..... E04B 2/7411 52/241
4,139,664 A * 2/1979 Wenrick ..... B29C 65/606 428/133
4,144,335 A ‡ 3/1979 Edwards ..... A01N 57/16 514/79
4,144,385 A * 3/1979 Downing ..... C08G 63/52 521/95
4,152,878 A * 5/1979 Balinski ..... E04B 1/941 52/481.1
4,164,107 A * 8/1979 Kraemling ..... E06B 3/305 52/232
4,178,728 A * 12/1979 Ortmanns ..... E06B 5/165 52/232
4,203,264 A * 5/1980 Kiefer ..... E06B 3/6715 52/1
4,276,332 A 6/1981 Castle
4,283,892 A * 8/1981 Brown ..... E04B 2/789 52/213
4,318,253 A * 3/1982 Wedel ..... E04H 15/54 52/309.1
4,329,820 A * 5/1982 Wendt ..... E04B 2/825 52/241
4,356,672 A 11/1982 Beckman et al.
4,361,994 A * 12/1982 Carver ..... E04B 2/7455 52/238.1
4,424,653 A * 1/1984 Heinen ..... E06B 5/165 52/204.55
4,434,592 A * 3/1984 Reneault ..... E04B 1/90 52/145
4,437,274 A * 3/1984 Slocum ..... E04D 1/265 52/105
4,454,690 A * 6/1984 Dixon ..... E04B 2/824 52/126.3
4,575,979 A 3/1986 Mariani
4,598,516 A 7/1986 Groshong
4,622,794 A * 11/1986 Geortner ..... E04B 2/90 52/235
4,649,089 A * 3/1987 Thwaites ..... E06B 5/164 428/85
4,672,785 A * 6/1987 Salvo ..... E04B 2/825 52/241
4,709,517 A * 12/1987 Mitchell ..... E04B 2/7412 52/145
4,711,183 A * 12/1987 Handler ..... A47B 57/402 108/107
4,723,385 A * 2/1988 Kallstrom ..... E04B 1/942 428/921
4,756,945 A * 7/1988 Gibb ..... E04B 1/941 428/124
4,761,927 A * 8/1988 O'Keeffe ..... E04B 1/6812 52/396.06
4,787,767 A * 11/1988 Wendt ..... E04B 2/825 403/187
4,805,364 A * 2/1989 Smolik ..... E04B 1/5818 52/241
4,822,659 A 4/1989 Anderson et al.
4,825,610 A * 5/1989 Gasteiger ..... E04B 2/825 52/217
4,845,904 A * 7/1989 Menchetti ..... A47B 57/425 52/36.6
4,850,385 A * 7/1989 Harbeke ..... A62C 2/065 137/75
4,854,096 A * 8/1989 Smolik ..... E04B 2/767 52/241
4,866,898 A 9/1989 LaRoche et al.
4,881,352 A 11/1989 Glockenstein
4,885,884 A * 12/1989 Schilger ..... E04B 5/04 52/354
4,899,510 A 2/1990 Propst
4,914,880 A 4/1990 Albertini
4,918,761 A * 4/1990 Harbeke ..... E03D 11/16 249/39
4,930,276 A * 6/1990 Bawa ..... E06B 5/162 52/208
4,935,281 A 6/1990 Tolbert et al.
5,010,702 A * 4/1991 Daw ..... E04B 2/7409 52/241
5,090,170 A 2/1992 Propst

(56) References Cited

U.S. PATENT DOCUMENTS 5,094,780 A * 3/1992 von Bonin ..... C04B 35/536 252/606
5,103,589 A * 4/1992 Crawford ..... E06B 3/4609 49/125
5,125,203 A * 6/1992 Daw ..... E04B 9/008 52/241
5,127,203 A * 7/1992 Paquette ..... E04B 2/822 52/241
5,127,760 A * 7/1992 Brady ..... E04B 2/825 403/230
5,146,723 A * 9/1992 Greenwood ..... E04B 2/825 52/241
5,155,957 A * 10/1992 Robertson ..... A62C 2/065 137/360
5,157,883 A * 10/1992 Meyer ..... E04B 2/766 24/460
5,167,876 A * 12/1992 Lem ..... B32B 5/12 252/602
5,173,515 A * 12/1992 von Bonin ..... C09K 21/06 521/103
5,203,132 A * 4/1993 Smolik ..... E04B 2/7409 403/230
5,212,914 A * 5/1993 Martin ..... E04F 13/12 52/235
5,222,335 A * 6/1993 Petrecca ..... E04B 2/7457 403/230
5,244,709 A * 9/1993 Vanderstukken ..... A62C 2/06 428/99
5,285,615 A * 2/1994 Gilmour ..... E04B 2/7412 52/781
5,315,804 A * 5/1994 Attalla ..... E04C 3/06 52/362
5,325,651 A * 7/1994 Meyer ..... E04B 2/766 52/243
5,347,780 A * 9/1994 Richards ..... B28B 1/525 52/204.1
5,367,850 A * 11/1994 Nicholas ..... E04F 19/028 52/232
5,374,036 A * 12/1994 Rogers ..... B22D 41/46 222/590
5,376,429 A * 12/1994 McGroarty ..... C04B 14/104 427/208.8
5,390,458 A * 2/1995 Menchetti ..... E04B 2/7457 428/122
5,390,465 A * 2/1995 Rajecki ..... A62C 2/065 285/211
5,394,665 A * 3/1995 Johnson ..... E04B 2/766 52/105
5,412,919 A * 5/1995 Pellock ..... E04B 2/60 52/241
5,452,551 A * 9/1995 Charland ..... A62C 2/065 52/1
5,454,203 A * 10/1995 Turner ..... E04B 2/706 52/368
5,456,050 A * 10/1995 Ward ..... A62C 2/065 52/1
5,460,864 A 10/1995 Heitkamp
5,471,791 A * 12/1995 Keller ..... E04B 2/827 160/40
5,471,805 A * 12/1995 Becker ..... E04B 2/7411 52/241
5,477,652 A * 12/1995 Torrey ..... B32B 13/12 52/309.13
5,552,185 A * 9/1996 De Keyser ..... B32B 27/18 427/358
5,592,796 A * 1/1997 Landers ..... E04B 2/7457 52/241
5,604,024 A * 2/1997 von Bonin ..... C04B 12/00 252/606
5,644,877 A * 7/1997 Wood ..... E04B 2/7407 52/126.3
5,687,538 A * 11/1997 Frobosilo ..... E04B 5/10 52/100
5,689,922 A * 11/1997 Daudet ..... E04B 2/58 52/204.1
5,709,821 A * 1/1998 von Bonin ..... C09K 21/02 252/606
5,724,784 A * 3/1998 Menchetti ..... E04B 2/7411 52/241
5,735,100 A * 4/1998 Campbell ..... E04B 1/3447 52/645
5,740,635 A 4/1998 Gil et al.
5,740,643 A * 4/1998 Huntley ..... E04B 1/94 52/265
5,755,066 A * 5/1998 Becker ..... E04B 2/7411 52/241
5,765,332 A * 6/1998 Landin ..... E04B 1/948 52/235
5,787,651 A * 8/1998 Horn ..... E04B 2/7412 52/144
5,797,233 A * 8/1998 Hascall ..... E04B 2/766 52/481.1
5,806,261 A * 9/1998 Huebner ..... E04B 2/7407 52/283
5,822,935 A * 10/1998 Mitchell ..... E04B 2/7455 52/239
5,870,866 A * 2/1999 Herndon ..... E02D 27/48 52/126.6
5,913,788 A * 6/1999 Herren ..... E04B 2/825 52/236.7
5,921,041 A * 7/1999 Egri, II ..... E04B 2/82 52/232
5,927,041 A * 7/1999 Sedlmeier ..... E04B 9/064 248/49
5,930,963 A * 8/1999 Nichols ..... E04B 2/7422 52/239
5,930,968 A * 8/1999 Pullam ..... E04C 3/32 52/481.1
5,945,182 A 8/1999 Fowler et al.
5,950,385 A * 9/1999 Herren ..... E04B 2/7453 52/479
5,968,615 A * 10/1999 Schlappa ..... E04B 1/948 428/34.1
5,968,669 A * 10/1999 Liu ..... C02F 1/72 428/313.5
5,970,672 A 10/1999 Robinson
5,974,750 A ‡ 11/1999 Landin ..... E04B 1/948 52/396
5,974,753 A * 11/1999 Hsu ..... E04F 13/0862 52/287.1
6,023,898 A * 2/2000 Josey ..... E04B 1/2403 52/309.5
6,058,668 A * 5/2000 Herren ..... E04B 2/825 52/236.7
6,061,985 A 5/2000 Kraus et al.
6,110,559 A ‡ 8/2000 De Keyser ..... B32B 27/18 428/68
6,116,404 A * 9/2000 Heuft ..... B07C 5/122 198/339.1
6,119,411 A 9/2000 Mateu Gil et al.
6,128,874 A * 10/2000 Olson ..... E04B 1/948 52/232
6,131,352 A * 10/2000 Barnes ..... E04B 1/948 52/396.01
6,151,858 A * 11/2000 Ruiz ..... E04B 5/29 52/344
6,153,668 A 11/2000 Gestner et al.
6,176,053 B1 * 1/2001 St Germain ..... E04B 2/825 52/232
6,182,407 B1 * 2/2001 Turpin ..... E04B 1/942 52/232
6,189,277 B1 * 2/2001 Boscamp ..... E04B 2/58 248/300
6,207,077 B1 * 3/2001 Burnell-Jones ..... C08J 5/043 252/301.36
6,207,085 B1 * 3/2001 Ackerman ..... C09K 21/12 162/159

(56) References Cited

U.S. PATENT DOCUMENTS 6,213,679 B1 * 4/2001 Frobosilo ..... E04B 2/82 403/14
6,216,404 B1 * 4/2001 Vellrath ..... E04B 2/7411 52/1
6,233,888 B1 ‡ 5/2001 Wu ..... E05D 15/0678 16/104
6,256,948 B1 * 7/2001 Van Dreumel ..... H02G 3/0412 52/220.8
6,256,960 B1 * 7/2001 Babcock ..... E04B 1/14 52/281
6,279,289 B1 * 8/2001 Soder ..... B21C 37/202 52/479
6,305,133 B1 * 10/2001 Cornwall ..... F16L 5/04 52/1
6,318,044 B1 * 11/2001 Campbell ..... E04B 1/3441 52/293.1
6,374,558 B1 * 4/2002 Surowiecki ..... E04B 2/7457 52/241
6,381,913 B2 * 5/2002 Herren ..... E04B 2/7457 52/479
6,405,502 B1 * 6/2002 Cornwall ..... F16L 5/04 285/42
6,430,881 B1 * 8/2002 Daudet ..... E04B 7/045 52/696
6,470,638 B1 * 10/2002 Larson ..... E04B 1/765 52/254
6,595,383 B2 * 7/2003 Pietrantoni ..... B65D 81/3858 220/560.11
6,606,831 B2 * 8/2003 Degelsegger ..... E06B 3/20 52/204.1
6,647,691 B2 * 11/2003 Becker ..... E04B 2/7457 403/242
6,668,499 B2 * 12/2003 Degelsegger ..... E06B 3/025 52/204.62
6,679,015 B1 * 1/2004 Cornwall ..... A62C 2/065 52/1
6,698,146 B2 ‡ 3/2004 Morgan ..... E04B 2/7411 52/232
6,705,047 B2 ‡ 3/2004 Yulkowski ..... E05F 3/22 16/65
6,711,871 B2 3/2004 Beirise et al.
6,732,481 B2 * 5/2004 Stahl, Sr. ..... A62C 2/065 52/220.1
6,739,926 B2 5/2004 Riach et al.
6,748,705 B2 * 6/2004 Orszulak ..... E04B 2/767 52/167.1
6,783,345 B2 ‡ 8/2004 Morgan ..... E04B 2/7411 425/11
6,799,404 B2 * 10/2004 Spransy ..... E04B 9/02 160/87
6,843,035 B1 * 1/2005 Glynn ..... E04B 2/7457 52/481.1
6,854,237 B2 * 2/2005 Surowiecki ..... E04B 2/7457 52/633
6,871,470 B1 * 3/2005 Stover ..... E04B 2/7457 403/109.1
6,951,162 B1 10/2005 Shockey et al.
7,043,880 B2 ‡ 5/2006 Morgan ..... E04B 2/7411 52/2.2
7,059,092 B2 * 6/2006 Harkins ..... E06B 5/164 52/210
7,104,024 B1 * 9/2006 diGirolamo ..... E04B 2/767 403/231
7,152,385 B2 ‡ 12/2006 Morgan ..... E04B 2/7411 52/745
7,191,845 B2 * 3/2007 Loar ..... A62C 2/065 169/48
7,240,905 B1 * 7/2007 Stahl, Sr. ..... E04B 1/681 277/652
7,251,918 B2 * 8/2007 Reif ..... E04F 13/0844 52/582.1
7,302,776 B2 * 12/2007 Duncan ..... E04D 13/17 454/260
7,398,856 B2 * 7/2008 Foster ..... E04B 2/7457 181/284
7,413,024 B1 * 8/2008 Simontacchi ..... A62C 2/065 169/48
7,487,591 B2 ‡ 2/2009 Harkins ..... E06B 5/164 29/897
7,506,478 B2 ‡ 3/2009 Bobenhausen ..... A62C 2/065 244/11
7,513,082 B2 * 4/2009 Johnson ..... E04B 2/7412 52/144
7,540,118 B2 ‡ 6/2009 Jensen ..... A62C 2/065 52/232
7,594,331 B2 * 9/2009 Andrews ..... E04B 2/761 29/37 R
7,617,643 B2 * 11/2009 Pilz ..... E04B 1/948 52/232
7,681,365 B2 ‡ 3/2010 Klein ..... E04B 2/7411 52/1
7,685,792 B2 ‡ 3/2010 Stahl, Sr. ..... F16L 5/04 52/220
7,716,891 B2 * 5/2010 Radford ..... E04F 13/0805 52/235
7,752,817 B2 * 7/2010 Pilz ..... E04B 2/82 52/207
7,775,006 B2 ‡ 8/2010 Giannos ..... E04B 1/948 52/236
7,776,170 B2 ‡ 8/2010 Yu ..... C04B 28/14 156/39
7,797,893 B2 * 9/2010 Stahl, Sr. ..... F16L 5/04 52/220.8
7,810,295 B2 * 10/2010 Thompson ..... E04H 9/14 248/208
7,814,718 B2 ‡ 10/2010 Klein ..... E04B 2/7457 52/1
7,827,738 B2 ‡ 11/2010 Abrams ..... E04B 1/003 52/79
7,866,108 B2 ‡ 1/2011 Klein ..... E04B 2/7411 52/481
7,870,698 B2 * 1/2011 Tonyan ..... B28B 5/027 106/735
7,921,614 B2 4/2011 Fortin et al.
7,941,981 B2 5/2011 Shaw
7,950,198 B2 ‡ 5/2011 Pilz ..... E04B 1/948 52/232
8,056,293 B2 ‡ 11/2011 Klein ..... E04B 2/7457 52/481
8,061,099 B2 * 11/2011 Andrews ..... E04B 2/7457 52/243.1
8,062,108 B2 * 11/2011 Carlson ..... A62C 2/12 454/369
8,069,625 B2 ‡ 12/2011 Harkins ..... E06B 5/164 52/210
8,074,412 B1 * 12/2011 Gogan ..... E04B 2/7403 52/1
8,074,416 B2 * 12/2011 Andrews ..... E04B 2/767 403/230
8,087,205 B2 * 1/2012 Pilz ..... E04B 1/948 52/232
8,100,164 B2 * 1/2012 Goodman ..... E06B 5/164 160/199
8,132,376 B2 ‡ 3/2012 Pilz ..... E04B 2/82 52/207
8,136,314 B2 ‡ 3/2012 Klein ..... E04B 2/7457 52/1
8,151,526 B2 * 4/2012 Klein ..... E04B 2/7457 52/1
8,181,404 B2 * 5/2012 Klein ..... E04B 2/7411 52/232
8,225,581 B2 * 7/2012 Strickland ..... E04C 3/07 52/481.1
8,281,552 B2 * 10/2012 Pilz ..... E04B 1/24 52/481.1
8,322,094 B2 ‡ 12/2012 Pilz ..... E04B 1/948 52/232

(56) References Cited

U.S. PATENT DOCUMENTS 8,353,139 B2 * 1/2013 Pilz ..... E04B 1/948 52/232
8,375,666 B2 2/2013 Stahl, Jr. et al.
8,413,394 B2 * 4/2013 Pilz ..... E04B 2/7411 52/207
8,495,844 B1 * 7/2013 Johnson, Sr. ..... E04F 19/0436 52/238.1
8,499,512 B2 * 8/2013 Pilz ..... E04B 1/24 52/235
8,555,566 B2 * 10/2013 Pilz ..... E04B 2/828 52/167.1
8,578,672 B2 ‡ 11/2013 Mattox ..... E04B 1/948 404/74
8,584,415 B2 * 11/2013 Stahl, Jr. ..... E04B 1/948 52/232
8,590,231 B2 * 11/2013 Pilz ..... E04B 2/7411 52/232
8,595,999 B1 * 12/2013 Pilz ..... E04B 1/943 52/232
8,596,019 B2 * 12/2013 Aitken ..... E04B 2/82 52/710
8,607,519 B2 * 12/2013 Hilburn ..... E04B 1/948 52/317
8,640,415 B2 * 2/2014 Pilz ..... E04B 2/7411 52/232
8,646,235 B2 * 2/2014 Hilburn, Jr. ..... E04B 1/948 52/232
8,671,632 B2 ‡ 3/2014 Pilz ..... E04B 1/948 52/232
8,728,608 B2 * 5/2014 Maisch ..... E04F 13/0889 428/139
8,793,947 B2 ‡ 8/2014 Pilz ..... E04B 2/7457 52/232
8,938,922 B2 ‡ 1/2015 Pilz ..... E04B 1/948 52/232
8,973,319 B2 ‡ 3/2015 Pilz ..... E04B 2/828 52/232
9,045,899 B2 * 6/2015 Pilz ..... E04B 2/7411
9,127,454 B2 ‡ 9/2015 Pilz ..... E04B 1/948
9,151,042 B2 ‡ 10/2015 Simon ..... E04B 1/944
9,206,596 B1 * 12/2015 Robinson ..... E04B 1/948
9,290,932 B2 ‡ 3/2016 Pilz ..... E04B 2/7457
9,290,934 B2 ‡ 3/2016 Pilz ..... E04B 2/828
9,371,644 B2 ‡ 6/2016 Pilz ..... E04B 1/948
9,458,628 B2 ‡ 10/2016 Pilz ..... E04B 2/7411
9,481,998 B2 ‡ 11/2016 Pilz ..... E04B 1/948
9,512,614 B2 ‡ 12/2016 Klein ..... E04B 2/7411
9,523,193 B2 * 12/2016 Pilz ..... E04B 1/945
9,551,148 B2 * 1/2017 Pilz ..... E04B 2/02
9,616,259 B2 ‡ 4/2017 Pilz ..... E04B 1/948
9,637,914 B2 ‡ 5/2017 Pilz ..... E04B 1/948
9,683,364 B2 ‡ 6/2017 Pilz ..... E04B 1/948
9,719,253 B2 ‡ 8/2017 Stahl, Jr. ..... E04B 2/7409
9,739,052 B2 ‡ 8/2017 Pilz ..... E04B 1/948
9,739,054 B2 ‡ 8/2017 Pilz ..... E04B 2/828
9,752,318 B2 ‡ 9/2017 Pilz ..... E04F 13/00
9,879,421 B2 ‡ 1/2018 Pilz ..... E04B 2/7411
9,909,298 B2 ‡ 3/2018 Pilz ..... E04B 2/02
9,931,527 B2 ‡ 4/2018 Pilz ..... E04B 1/948
9,995,039 B2 ‡ 6/2018 Pilz ..... E04B 2/828
10,000,923 B2 ‡ 6/2018 Pilz ..... E04B 1/948
10,011,983 B2 ‡ 7/2018 Pilz ..... E04B 1/948
10,077,550 B2 ‡ 9/2018 Pilz ..... E04B 1/948
10,184,246 B2 1/2019 Pilz et al.
10,214,901 B2 2/2019 Pilz et al.
10,227,775 B2 3/2019 Pilz et al.
10,246,871 B2 4/2019 Pilz
10,406,389 B2 * 9/2019 Pilz ..... E04B 2/7411
10,563,399 B2 2/2020 Pilz et al.
2002/0029535 A1 * 3/2002 Loper ..... E04F 17/00 52/302.1
2002/0160149 A1 * 10/2002 Garofalo ..... B63C 11/02 428/139
2002/0170249 A1 * 11/2002 Yulkowski ..... E05F 3/22 52/210
2003/0079425 A1 * 5/2003 Morgan ..... E04B 2/7411 52/232
2003/0089062 A1 ‡ 5/2003 Morgan ..... E04B 2/7411 52/317
2003/0196401 A1 * 10/2003 Surowiecki ..... E04B 2/7457 52/481.2
2003/0213211 A1 ‡ 11/2003 Morgan ..... E04B 2/7411 52/745
2004/0010998 A1 * 1/2004 Turco ..... E04F 13/0826 52/762
2004/0016191 A1 * 1/2004 Whitty ..... F16L 5/04 52/232
2004/0045234 A1 * 3/2004 Morgan ..... E04B 2/7411 52/232
2004/0139684 A1 * 7/2004 Menendez ..... E04C 3/07 52/831
2004/0211150 A1 * 10/2004 Bobenhausen ..... A62C 2/065 52/741.3
2005/0183361 A1 * 8/2005 Frezza ..... E02D 27/00 52/293.3
2005/0246973 A1 * 11/2005 Jensen ..... A62C 2/065 52/95
2006/0032163 A1 * 2/2006 Korn ..... E04B 1/68 52/241
2006/0123723 A1 * 6/2006 Weir ..... B32B 5/245 52/302.1
2007/0056245 A1 * 3/2007 Edmondson ..... E04B 1/24 52/848
2007/0068101 A1 ‡ 3/2007 Weir ..... B32B 7/02 52/302
2007/0130873 A1 * 6/2007 Fisher ..... E04B 2/18 52/596
2007/0175140 A1 * 8/2007 Giannos ..... E04B 1/948 52/317
2007/0193202 A1 * 8/2007 Rice ..... E04B 2/7457 52/481.1
2007/0261343 A1 * 11/2007 Stahl, Sr. ..... F16L 5/04 52/396.01
2008/0087366 A1 * 4/2008 Yu ..... C04B 28/14 156/39
2008/0134589 A1 ‡ 6/2008 Abrams ..... F24D 3/145 52/79
2008/0172967 A1 * 7/2008 Hilburn ..... E04B 1/948 52/396.01
2008/0196337 A1 * 8/2008 Surowiecki ..... E04B 2/7457 52/241
2008/0250738 A1 * 10/2008 Howchin ..... E04B 2/789 52/235
2009/0090074 A1 * 4/2009 Klein ..... E04B 2/7411 52/232
2009/0223159 A1 * 9/2009 Colon ..... E04B 2/7409 52/404.1
2010/0170172 A1 * 7/2010 Klein ..... E04B 2/7411 52/232
2010/0199583 A1 8/2010 Behrens et al.
2011/0041415 A1 * 2/2011 Esposito ..... E04B 1/34331 52/12
2011/0056163 A1 * 3/2011 Kure ..... E04B 1/942 52/741.3
2011/0067328 A1 * 3/2011 Naccarato ..... E04F 11/00 52/182
2011/0099928 A1 * 5/2011 Klein ..... E04B 2/7457 52/232
2011/0146180 A1 * 6/2011 Klein ..... E04B 2/7409 52/317
2011/0167742 A1 ‡ 7/2011 Klein ..... E04B 2/7411 52/232
2011/0185656 A1 * 8/2011 Klein ..... E04B 1/94 52/232
2011/0214371 A1 * 9/2011 Klein ..... E04B 1/94 52/232
2012/0023846 A1 * 2/2012 Mattox ..... E04B 1/948 52/232

(56) References Cited

U.S. PATENT DOCUMENTS

| | | | | |
|---|---|---|---|---|
| 2012/0247038 | A1* | 10/2012 | Black | E04C 2/22 52/220.1 |
| 2012/0266550 | A1‡ | 10/2012 | Naccarato | E04F 11/00 52/182 |
| 2012/0297710 | A1* | 11/2012 | Klein | E04B 2/7411 52/232 |
| 2013/0031856 | A1* | 2/2013 | Pilz | E04B 2/7457 52/232 |
| 2013/0118102 | A1* | 5/2013 | Pilz | E04B 1/947 52/232 |
| 2013/0205694 | A1 | 8/2013 | Stahl, Jr. | |
| 2014/0219719 | A1* | 8/2014 | Hensley | E01C 11/14 404/57 |
| 2015/0135631 | A1* | 5/2015 | Foerg | E04B 2/7411 52/717.04 |
| 2015/0275510 | A1* | 10/2015 | Klein | E04B 1/948 52/232 |
| 2016/0017598 | A1* | 1/2016 | Klein | E04B 2/7411 52/232 |
| 2016/0017599 | A1* | 1/2016 | Klein | E04B 2/7411 52/232 |
| 2016/0097197 | A1* | 4/2016 | Pilz | E04B 2/7411 52/232 |
| 2016/0130802 | A1* | 5/2016 | Pilz | E04B 1/948 52/232 |
| 2016/0208484 | A1* | 7/2016 | Pilz | E04F 13/00 |
| 2016/0265219 | A1‡ | 9/2016 | Pilz | E04B 2/828 |
| 2017/0016227 | A1* | 1/2017 | Klein | E04B 1/948 |
| 2017/0175386 | A1* | 6/2017 | Pilz | E04B 1/948 |
| 2017/0198473 | A1* | 7/2017 | Pilz | E04B 2/7411 |
| 2017/0234004 | A1* | 8/2017 | Pilz | E04B 1/948 52/232 |
| 2017/0260741 | A1* | 9/2017 | Ackerman | E04B 1/947 |
| 2017/0306615 | A1 | 10/2017 | Klein et al. | |
| 2017/0328057 | A1* | 11/2017 | Pilz | E04B 1/948 |
| 2018/0010333 | A1* | 1/2018 | Foerg | E04B 2/7411 |
| 2018/0044913 | A1 | 2/2018 | Klein et al. | |
| 2018/0171624 | A1 | 6/2018 | Klein et al. | |
| 2018/0195282 | A1* | 7/2018 | Pilz | E04B 2/7411 |
| 2018/0289994 | A1‡ | 10/2018 | Pilz | E04B 1/948 |
| 2018/0347189 | A1‡ | 12/2018 | Pilz | E04B 2/828 |
| 2018/0363293 | A1 | 12/2018 | Pilz | |
| 2019/0284797 | A1* | 9/2019 | Pilz | E04B 1/948 |
| 2019/0316348 | A1 | 10/2019 | Pilz | |
| 2019/0316350 | A1 | 10/2019 | Pilz | |
| 2019/0330842 | A1 | 10/2019 | Pilz | |
| 2019/0338513 | A1* | 11/2019 | Pilz | E04B 2/7457 |
| 2019/0344103 | A1 | 11/2019 | Pilz | |

FOREIGN PATENT DOCUMENTS

| | | |
|---|---|---|
| CA | 2736834 | 12/2015 |
| CA | 2803439 | 3/2017 |
| CA | 2827183 | 7/2018 |
| CA | 3036429 | 9/2019 |
| CA | 3041494 | ‡ 10/2019 |
| EP | 0 346 126 | 12/1989 |
| GB | 2 159 051 | 11/1985 |
| GB | 2 411 212 | 8/2005 |
| JP | 06-146433 | 5/1994 |
| JP | 06-220934 | 8/1994 |
| WO | WO 2003/038206 | 5/2003 |
| WO | WO 2007/103331 | 9/2007 |
| WO | WO 2009/026464 | 6/2009 |

OTHER PUBLICATIONS

U.S. Appl. No. 15/943,349, filed Apr. 2, 2018.‡
U.S. Appl. No. 15/986,280, filed May 22, 2018.‡
U.S. Appl. No. 16/001,228, filed Jun. 6, 2018.‡
BlazeFrame 2009 catalog of products, available at least as of Mar. 4, 2010 from www.blazeframe.com, in 20 pages.‡
Canadian First Office Action for Application No. 2,697,295, dated Sep. 21, 2011, in 4 pages.‡
Canadian Second Office Action for Application No. 2,697,295, dated May 23, 2012, in 4 pages.‡
Canadian Office Action for Application No. 2,827,183, dated Mar. 27, 2015 in 4 pages.‡
Canadian Office Action for Application No. 2,827,183, dated Mar. 7, 2016 in 4 pages.‡
Catalog page from Stockton Products, printed from www.stocktonproducts.com, on Dec. 16, 2007, showing #5 Drip, in 1 page.‡
ClarkDietrich Building Systems, Product Submittal Sheet, (FTSC) Flat Trail Vertical Slide Clip. CD- FTSC11 Jul. 2011. 1 page.‡
DoubleTrackTM information sheets by Dietrich Metal Framing, in 2 pages; accessible on Internet Wayback Machine on Jul. 8, 2006.‡
FireStikTM by CEMCO Brochure, published on www.firestik.us, in 18 pages; accessible on Internet Wayback Machine on Aug. 13, 2007.‡
Information Disclosure Statement letter; U.S. Appl. No. 12/196,115, dated Aug. 4, 2011.‡
International Search Report for Application No. PCT/US2008/073920, dated Apr. 9, 2009.‡
"Intumescent Expansion Joint Seals", Astroflame; http://www.astroflame.com/intumescentexpansion jointseals; Jul. 2011; 4 pages.‡
James A. Klein's Answer, Affirmative Defenses and Counterclaims to Third Amended Complaint; U.S. District Court, Central District of California; Case No. 2:12-cv-10791-DDP-MRWx; Filed Sep. 17, 2014; pp. 1-37.‡
Letter from Thomas E. Loop; counsel for defendant; Jun. 26, 2015.‡
Expert Report of James William Jones and exhibits; Case No. CV12-10791 DDP (MRWx); May 18, 2015.‡
Letter from Ann G. Schoen of Frost Brown Todd, LLC; Jun. 24, 2015.‡
"System No. HW-D-0607", May 6, 2010, Metacaulk, www.rectorseal.com, www.metacault.com; 2008 Underwriters Laboratories Inc.; 2 pages.‡
Trim-Tex, Inc., Trim-Tex Wall Mounted Deflection Bead Installation Instructions, 2 pages. [Undated. Applicant requests that the Examiner review and consider the reference as prior art for the purpose of examination.]‡
"Wall Mounted Deflection Bead," Trim-Tex Drywall Products; Oct. 9, 2016; 3 pages.‡
Canadian Office Action for Application No. 2,802,579, dated Jan. 3, 2019 in 3 pages.‡
U.S. Appl. No. 16/598,211, filed Oct. 10, 2019.‡
U.S. Appl. No. 16/598,211, filed Oct. 10, 2019, Pliz.
Canadian Office Action for Applicaton No. 2,802,579, dated Jan. 3, 2019 in 3 pages.
U.S. Appl. No. 16/791,869, filed Feb. 14, 2020 Pilz et al.
U.S. Appl. No. 16/809,401, filed Mar. 4, 2020 Pilz.

* cited by examiner
‡ imported from a related application

FIRE-RATED JOINT COMPONENT AND WALL ASSEMBLY

INCORPORATION BY REFERENCE

Any and all applications for which a foreign or domestic priority claim is identified in the Application Data Sheet as filed with the present application are hereby incorporated by reference in their entirety.

BACKGROUND

Field

The disclosure generally relates to fire-rated building structures. In particular, the disclosure relates to fire-rated joint systems, wall assemblies, and other building structures that incorporate the fire-rated joint systems.

Description of Related Art

Fire-rated construction components and assemblies are commonly used in the construction industry. These components and assemblies are aimed at inhibiting or preventing fire, heat, or smoke from leaving one room or other portion of a building and entering another room or portion of a building. The fire, heat or smoke usually moves between rooms through vents, joints in walls, or other openings. The fire-rated components often incorporate fire-retardant materials which substantially block the path of the fire, heat or smoke for at least some period of time. Intumescent materials work well for this purpose, because they swell and char when exposed to flames helping to create a barrier to the fire, heat, and/or smoke.

One particular wall joint with a high potential for allowing fire, heat or smoke to pass from one room to another is the joint between the top of a wall and the ceiling, which can be referred to as a head-of-wall joint. In modern multi-story or multi-level buildings, the head-of-wall joint is often a dynamic joint in which relative movement between the ceiling and the wall is permitted. This relative movement is configured to accommodate deflection in the building due to loading of the ceiling or seismic forces. The conventional method for creating a fire-rated head-of-wall joint is to stuff a fire-resistant mineral wool material into the head-of-wall joint and then spray an elastomeric material over the joint to retain the mineral wool in place. This conventional construction of a fire-rated head-of-wall joint is time-consuming, expensive and has other disadvantages.

A wall assembly commonly used in the construction industry includes a header track, bottom track, a plurality of wall studs and a plurality of wall board members, possibly among other components. A typical header track resembles a generally U-shaped (or some other similarly shaped) elongated channel capable of receiving or covering the ends of wall studs and holding the wall studs in place. The header track also permits the wall assembly to be coupled to an upper horizontal support structure, such as a ceiling or floor of a higher level floor of a multi-level building.

Header tracks generally have a web and a pair of flanges, which extend in the same direction from opposing edges of the web. The header track can be a slotted header track, which includes a plurality of slots spaced along the length of the track and extending in a vertical direction. When the wall studs are placed into the slotted track, each of the plurality of slots aligned with a wall stud accommodates a fastener used to connect the wall stud to the slotted track. The slots allow the wall studs to move generally orthogonally relative to the track, creating a variable deflection gap between the wallboard and the upper horizontal support structure. In those areas of the world where earthquakes are common, movement of the wall studs is important. If the wall studs are rigidly attached to the slotted track and not allowed to move freely in at least one direction, the stability of the wall and the building might be compromised. With the plurality of slots, the wall studs are free to move. Even in locations in which earthquakes are not common, movement between the studs and the header track can be desirable to accommodate movement of the building structure due to other loads, such as stationary or moving overhead loads.

Recently, improvements to fire-rated head-of-wall joints have been developed. One example is the use a metal profile having a layer of intumescent material in a head-of-wall joint, such as the fire-rated angle manufactured and sold by the Applicant under the trade name Deflection Drift Angle (DDA™). The DDA™ angle is further described in U.S. Pat. No. 8,595,999, the entirety of which is hereby incorporated by reference. The DDA™ angle can be installed along with the installation of the header track or can be installed after the installation of the header track. Such an arrangement avoids the need to have the framers return after the installation of the wall board to install fire sealant in the deflection gap between the edge of the wall board and the overhead structure. When temperatures rise (e.g., due to a fire), the intumescent material on the DDA™ fire block product expands. This expansion creates a barrier which fills the deflection gap and inhibits or at least substantially prevents fire, heat and smoke from moving through the head-of-wall joint and entering an adjacent room for at least some period of time.

SUMMARY

Although the DDA™ fire block represents an improvement over the conventional method of stuffing mineral wool material into the head-of-wall joint and applying the elastomeric spray material over the mineral wool, there still exists room for improved or alternative products, materials and methods for efficiently and cost-effectively creating fire-rated wall joints. The systems, methods and devices described herein have innovative aspects, no single one of which is indispensable or solely responsible for their desirable attributes. Without limiting the scope of the claims, some of the advantageous features will now be summarized.

One aspect of the present disclosure is a head-of-wall assembly that allows dynamic movement. The assembly includes a header track configured to be coupled to an upper surface. The header track has a web and first and second flanges extending from the web in the same direction. Each of the first and second flanges is substantially planar such that the track defines a substantially U-shaped cross section. At least one stud is coupled to the header track. An upper end of the stud is located between the first and second flanges. A wallboard is coupled to the stud. An upper end of the wallboard overlaps the first flange of the header track. A deflection gap is formed between the upper end of the wallboard and the upper surface. The deflection gap being variable between a closed position and an open position. A gasket profile has a vinyl profile, the vinyl profile has an upper flange, a body flange defining an air gap, a bubble gasket, and a leg portion. The leg portion is substantially vertical. A foam tape is configured to couple the vinyl profile to the first flange of the header track.

In another aspect of the assembly, the foam tape is positioned between the leg flange and the wallboard and the leg portion and the foam tape space the wallboard out from the first flange of the header track to create a spacing.

In another aspect of the assembly, a head of a fastener attaching the at least one stud with the first flange of the header track fits within the spacing.

In another aspect of the assembly, the foam tape attaches the leg flange with the header track along a length of the vinyl profile.

In another aspect of the assembly, a foil lining is attached to the vinyl profile in the air gap, and an intumescent material is attached to the foil lining within the air gap.

In another aspect of the assembly, the foam tape creates a seal along an entire length of the leg portion.

One aspect of head-of-wall assemblies including a fire-blocking gasket according to the present disclosure is sealing of the head-of-wall joint against noise, heat and/or smoke. Noise, smoke, heat, etc. can pass between adjacent room across a head-of-wall assembly. In some head-of-wall assemblies, the noise, smoke or heat can pass through the deflection gap. The more open the deflection gap, the more noise, smoke or heat that can pass and the more closed the joint, the less noise, smoke or heat that can pass. Sealing against noise, smoke or heat passing across a head-of-wall joint can advantageously provide the benefits of sound, smoke or heat isolation and containment. Thus, various embodiments of this disclosure relate to improved sealing across a head-of-wall assembly using an improved fire-blocking gasket.

Another aspect of some header block assemblies having a fire-blocking gasket in the present disclosure is the use of a vinyl material (or other polymer or plastic material) for a profile of the fire-blocking gasket. Vinyl material offers several advantages over known materials in fire-blocking gaskets and similar assemblies. For example, vinyl material can be incredibly flexible and can function to aid in the sealing across head-of-wall assembly. The vinyl material can also allow for compressible track profiles that can collapse and expand within a head-of-wall assembly corresponding to the closed and open positions of the deflection gap. Vinyl material can be easily extruded and co-extruded with other materials. The vinyl material can also be produced cheaply and in large quantities and it also ships lighter than other materials (e.g. metals) having similar volumes and dimensions.

Another aspect of some head-of-wall assemblies including a fire-blocking gasket according to the present disclosure is the use of an air gap within the track profile. The air gap can be located within the fire-blocking gasket profile and can reduce the transfer of heat to a thermocouple for use in UL testing. This can allow the fire-blocking gasket profile to pass the test by reducing the transfer of heat via the air gap. The air gap can reduce heat transferred to an intumescent material assembled within the air gap. The intumescent material can be positioned within the air gap.

Another aspect of some head-of-wall assemblies having a fire-blocking gasket profile according to the present disclosure is the use of a foil tape or other foil layer lining the vinyl profile. For example, the foil tape can fully or partially line the air gap within the vinyl profile. The intumescent material can be attached to the foil tape and the foil tape can be attached to the vinyl material. The foil tape can provide additional protection for the vinyl material and the intumescent material and/or containment of the intumescent material during expansion of the intumescent material.

Another aspect of some head-of-wall assemblies having a fire-blocking gasket profile according to the present disclosure is a vinyl profile that has an outward facing contoured and/or round profile that can compress flatly against the leg of a header track of the head-of-wall assembly. The vinyl profile can compress flat against the leg of the header track when the deflection gap is in the fully closed position and it can spring back out when the deflection gap is in the open position.

In one embodiment a fire-blocking gasket profile is an elongate, multi-layer fire-rated joint component (e.g., head-of-wall component) comprising three layers. A first layer is a vinyl profile. A second layer is a foil liner. A third layer is a strip of intumescent material. The second layer (foil liner) can be located between the intumescent material and the vinyl profile. The third layer (intumescent strip) can be attached to the second layer or to the first layer on an inner surface of the leg of the vinyl profile.

Another aspect of the fire-blocking gasket profile is the vinyl profile has an outward facing round contoured profile that will compress generally flat against the leg of the track when a deflection gap of the head-of-wall assembly is in a closed position and spring back out when the deflection gap is in an open position. The round contoured profile can aid in sealing across the head-of-wall assembly by engaging with a ceiling structure thereof.

Another aspect of the fire-blocking gasket profile is that the foil liner provides further heat protection to the vinyl and/or intumescent material. This extra heat protection allows the intumescent material to expand and fully seal off the deflection gap even after the vinyl material begins to burn away and before the foil liner burns away. In some configurations, vinyl burns away at approximately 500° F. and foil tape burns away at approximately 1200° F.

Another aspect of the fire-blocking gasket profile is an air gap within the vinyl profile. The air gap can contain or partially contain the intumescent material. The foil liner can at least partially line the air gap. The air gap can slow the transfer of heat across the fire-blocking gasket profile to allow passage of UL testing and/or to delay or slow the expansion of the intumescent material.

In another aspect of this disclosure, the vinyl profile can be attached within the head of wall assembly by a foam tape. The foam tape can be attached along a leg flange of the vinyl profile. The foam tape can have adhesive on either side thereof; one side can attach with the leg of the vinyl profile and the other side can attach with a leg of the header track within the head of wall assembly.

In another aspect, the foam tape can improve the seal of the bubble gasket with the ceiling and/or the seal between the leg flange and the header track of the head of wall assembly. Mechanical fasteners attaching the vinyl profile with the header track can allow sagging. The sagging can inhibit the seal of the vinyl profile with the header track and/or the seal of the bubble gasket with the ceiling (e.g., at spans between mechanical fasteners). Accordingly, the foam tape can improve the seal by providing a continuous (or nearly continuous) support to the vinyl profile.

In another aspect, the foam tape can create a spacing between the header track and the wallboard. The spacing can fit a head of a fastener attaching the studs to the header track. The spacing can allows for movement of the fastener head within the head of wall assembly due to cycling movement between the ceiling and the studs.

In another aspect, the vinyl profile can include a foil and/or intumescent layer and be used for fire, smoke, and sound sealing. In another aspect, the vinyl profile can be without the foil and/or intumescent layer and be used for sound sealing.

An aspect of the present disclosure involves a fire-rated component for sealing a head of wall gap. The component includes an elongate body comprising at least a first layer of a first material. The first layer includes a planar lower portion configured to allow the component to be secured to a flange of a header track of a wall assembly and a non-planar upper portion configured to seal against an overhead structure above the wall assembly. The non-planar upper portion is further configured to define an air gap between an interior surface of the component and the flange of the header track.

In some configurations, the non-planar upper portion comprises a first portion and a second portion, the first portion being relatively closer to the planar lower portion and extending therefrom in a first direction, the second portion extending from the first portion in a second direction opposite the first direction such that, in an in-use orientation, the first portion extends away from the flange of the header track and the second portion extends toward to the flange.

In some configurations, the first portion comprises a planar section.

In some configurations, the second portion comprises a curved section.

In some configurations, the second portion comprises at least one planar section.

In some configurations, the second portion comprises a first planar section and a second planar section, wherein the second planar section is parallel to the planar lower portion.

In some configurations, the first layer further comprises a hollow gasket portion positioned on an upper end of the non-planar upper portion and configured to contact the overhead structure.

In some configurations, the hollow gasket portion has a circular cross-sectional shape.

In some configurations, the first material is a polymer.

In some configurations, the polymer is a vinyl.

In some configurations, the fire-rated component further includes a second layer of a foil material.

In some configurations, the second layer covers at least a portion of the interior surface of the first layer.

In some configurations, the second layer covers at least a portion of the interior surface of the non-planar upper portion.

In some configurations, the fire-rated component further includes a third layer, which comprises an intumescent material.

In some configurations, the third layer is located only on the interior surface side of the non-planar upper portion.

In some configurations, the second layer is located between the first layer and the third layer.

In some configurations, a melting temperature of the foil material is greater than an expansion temperature of the intumescent material.

In some configurations, the melting temperature of the foil material is greater than a melting temperature of the first material.

In some configurations, an adhesive tape is positioned on the interior surface side of the planar lower portion and configured to secure the component to the flange of the header track.

In some configurations, the adhesive tape is a foam tape.

An aspect of the present disclosure includes a wall assembly having a header track configured to be coupled to a surface of an overhead structure. The header track has a web and first and second flanges extending from the web in the same direction, wherein each of the first and second flanges is substantially planar such that the track defines a substantially U-shaped cross section. At least one stud is coupled to the header track, and an upper end of the stud is located between the first and second flanges. At least one wallboard is coupled to the stud, and an upper end of the wallboard overlaps the first flange of the header track. A deflection gap is formed between the upper end of the wallboard and the surface of the overhead structure, with the deflection gap being variable between a closed position and an open position. The wall assembly includes a fire-rated component as described herein, wherein the planar lower portion is coupled to the first flange of the header track and positioned between the first flange and the wallboard, and the non-planar upper portion is positioned at least partially within the deflection gap in the open position and contacts the surface of the overhead structure.

In some configurations, the non-planar upper portion is configured to collapse to reduce the air gap in response to upward movement of the at least one wallboard over the non-planar upper portion.

An aspect of the present disclosure involves a method of creating a fire-rated head-of-wall gap, the method including securing a header track to an overhead structure, positioning an upper end of a stud into the header track, and coupling a planar lower portion of a fire-rated component to the header track such that a non-planar upper portion of the fire-rated component cooperates with a flange of the header track to define an air gap between the fire-rated component and the header track.

In some configurations, a bubble portion of the fire-rated component is engaged with the overhead structure to seal the deflection gap of the fire-rated head-of-wall gap against the passage of smoke and noise.

In some configurations, a wallboard member is secured to the stud such that the planar lower portion of the fire-rated component is positioned between the wallboard member and the header track.

In some configurations, the fire-rated component comprises a first layer of a vinyl material.

In some configurations, the fire-rated component further comprises a second layer comprising a foil lining.

In some configurations, the fire-rated component further comprises a third layer comprising an intumescent material.

BRIEF DESCRIPTION OF THE DRAWINGS

Various embodiments are depicted in the accompanying drawings for illustrative purposes, and should in no way be interpreted as limiting the scope of the embodiments. Various features of different disclosed embodiments can be combined to form additional embodiments, which are part of this disclosure.

DETAILED DESCRIPTION

The various features and advantages of the systems, devices, and methods of the technology described herein will become more fully apparent from the following description of the embodiments illustrated in the figures. These embodiments are intended to illustrate the principles of this disclosure, and this disclosure should not be limited to merely the illustrated examples. The features of the illustrated embodiments can be modified, combined, removed, and/or substituted as will be apparent to those of ordinary skill in the art upon consideration of the principles disclosed herein.

The following disclosure provides an elongate, multi-layer fire-rated joint component or fire-blocking gasket profile or profile, which is configured to provide fire protection and pass the relevant UL fire rating tests, or other relevant fire rating tests or standards. The multi-layer fire-rated joint component may be installed in a deflection gap of a wall assembly that allows dynamic movement according to the requirements of UL-2079.

Figure 1:
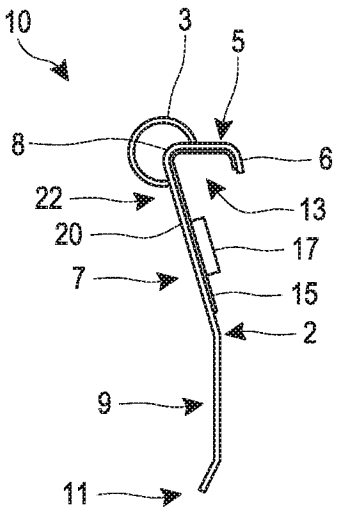
FIG. 1 illustrates a fire-blocking component in the form of a strip according to a first embodiment.

FIG. 1 illustrates a fire-rated or fire-blocking component, which can be an elongate strip or gasket profile 10. The fire-blocking gasket profile 10 can be assembled along an upper edge of a wall within a head-of-wall assembly as illustrated further in FIG. 3. The gasket profile 10 can be used to seal across a dynamic head-of-wall assembly and thereby prevent passage of smoke, heat, noise and/or other gasses from passing through the head-of-wall assembly from one side of the wall to the other. In certain implementations, the gasket profile 10 can be formed in various lengths (e.g., 5', 10', 12' or other) each preferably having the same cross-sectional shape throughout.

In some configurations, the gasket profile 10 includes one, two or three layers. The first layer, or profile layer 2, can be or include a vinyl material having a non-linear profile or cross-sectional shape. In the illustrated arrangement, the profile layer 2 is a base layer of the component and defines the basic cross-sectional shape or profile of the gasket profile 10. Accordingly, the first layer 2 can be referred to herein as a profile layer 2. However, because profile layer 2 defines the basic structure of the component in the illustrated arrangement, the term "profile" can also be used to refer to either the first layer or the entire component or gasket profile 10 as will be made clear by the context of use. Unlike a steel profile or a profile constructed of another metal material, the illustrated profile layer 2 can be very flexible. In some embodiments, the profile layer 2 may be formed from other non-metal materials such as plastic, polyvinyl chloride (PVC), polyethylene or any other suitable plastic. The profile layer 2 can provide structure to the gasket profile 10.

The gasket profile 10 can include an optional second layer 15. The second layer 15 preferably is constructed of a material or materials having a higher melting temperature than the profile layer 2. In some configurations, the second layer 15 can be or include a thin metal material, such as a foil lining 15. The gasket profile 10 can include an optional third layer 17. The third layer 17 can be or include a fire-blocking or fire-resistant material, such as an intumescent material strip 17. The gasket profile 10 can include the profile layer 2 in combination with either or both of the second layer 15 and the third layer 17. The second layer 15 and the third layer 17 can be attached to the first layer or profile layer 2. With such an arrangement, the foil lining 15 can provide benefits of a metal layer, but using a much smaller amount of metal, or by using a material with metal-like properties, so that the overall weight and cost of the gasket profile 10 is lower and the flexibility is greater in comparison to a metal track. Similarly, the third layer 17 can provide the desired benefit of an expandable fire-blocking material without the expense of using more expandable fire-blocking material than needed or desired for the particular gap being protected.

The profile layer 2 can include a leg portion 7 configured in use to extend along a leg or flange of a header track. From a cross-sectional or profile view, the leg portion 7 can be formed of a single straight segment, several straight segments and/or curved segments or a combination thereof. The leg portion 7 need not be straight throughout. The leg portion 7 can include a fastener location 9. The fastener location 9 can be or include a straight segment, which can also be referred to as a planar lower portion. In some implementations, the straight segment of the fastener location 9 can be pre-punched or pre-perforated such that a fastener (e.g., a mechanical fastener such as a screw, nail, staple or other) can pass through the leg portion 7. The fastener location 9 can be configured to receive an adhesive (e.g., can include a roughed or contoured surface).

The leg portion 7 can include a lower flange 11. The lower flange 11 can be located below, and can be proximate to, the fastener location 9. The lower flange 11 can form an angle with the straight segment of the fastener location 9. Accordingly, the bottom edge of the gasket profile 10 can be spaced away from the corresponding leg of the header track so that a stud fastener can move from below to behind the gasket profile 10 without damaging, or with reduced damage, to the gasket profile 10. The angle of the lower flange 11 also can be configured to provide rigidity to the gasket profile 10.

An upper end of the leg portion 7 can be coupled with a second leg portion 5, which is referred to herein as a horizontal portion 5. The horizontal portion 5 can couple with the leg portion 7 at a corner 8. The horizontal portion 5 can be generally horizontal or otherwise extend away from the generally vertically-oriented leg portion 7. In an alternative arrangement, the second leg portion 5 extends in a somewhat downward direction towards the leg portion 7, such as at an angle of between about 30-60 degrees, or about 45 degrees from horizontal in the orientation of FIGS. 1 and 2. The horizontal portion 5 can comprise one or more straight and/or curved components or any combination thereof. The horizontal portion 5 can support an upper flange 6 on an edge opposite the leg portion 7. The upper flange 6 can be a straight and/or curved portion that couples with the horizontal portion 5 and preferably extends downwardly therefrom (or in the same general direction as the leg portion 7). The upper flange 6 can be configured to directly or indirectly engage a surface of a corresponding header track to facilitate folding movement of the horizontal portion 5, as is described further below. The horizontal portion 5 alone or in combination with the upper flange 6 can be referred to herein as a spring leg or spring flange. In some implementations the upper flange 6 is parallel to and/or aligns with the straight segment of the fastener location 9 (e.g., in an expanded configuration of the gasket profile 10).

The profile layer 2 can form an air gap 13 by itself or along with a cooperating structure, such as a header track. For example, any one or more of the leg portion 7, the horizontal portion 5 and the upper flange 6 can form the air gap 13. In the illustrated arrangement, at least an upper angled portion 20 of the leg portion 7 and the horizontal portion 5 (optionally, and the upper flange 6) form a non-planar upper portion 22 that partially or fully defines the air gap 13. The upper angled portion 20 of the leg portion 7 can be a first portion of the non-planar upper portion that extends in a first direction away from the header track from the planar lower portion of the leg portion 7. The horizontal portion 5 (optionally, and the upper flange 6) can be a second portion of the non-planar upper portion that extends in a second direction toward the header track from the first portion. The horizontal portion 5 can be a first planar section of the second portion and the upper flange 6 can be a second planar section of the second portion. The upper flange 6 can be parallel or substantially parallel to the planar lower portion or fastener location 9.

The air gap 13 can be a partially or fully enclosed space defined by the profile layer 2. The air gap 13 can be at least partially collapsible. For example, the horizontal portion 5 can be foldable or bendable with respect to the leg portion 7 (e.g., at the corner 8 or along the lengths of the horizontal portion 5 or leg portion 7). The at least partial collapse of the air gap 13 can allow the gasket profile 10 to be compressed into a flat, relatively flat or generally flattened state. The material of the profile layer 2 can be elastic such that the compression and collapse of the air gap 13 is repeatable and the gasket profile 10 can return to its undeflected or natural shape when the flattening force is removed.

The profile layer 2 can include an optional sealing portion or member, which in the illustrated arrangement is in the form of a bubble gasket 3. The bubble gasket 3 can be coupled to or a segment of the profile layer 2 that is extended from the leg portion 7 and/or the horizontal portion 5. In one example, the bubble gasket 3 can be connected to the leg portion 7 at a first end and coupled to the horizontal portion 5 at a second end (from a cross-sectional or end view perspective), as illustrated in FIG. 1. The bubble gasket 3 can comprise a flexible material. In some implementations, this flexible material of the bubble gasket 3 can be the same material as the profile layer 2 and formed as a single or unitary structure with the profile layer 2. In other implementations, the flexible material of the bubble gasket 3 can be a different material than the material of the profile layer 2. For example, the bubble gasket 3 can be formed of a rubber, elastomeric polymer or other plastic material. The material of the bubble gasket 3 can be co-extruded and/or otherwise adhered or mechanically affixed (e.g., within one or more slots) to the profile layer 2. Thus, the use of the term "layer" in connection with the profile layer 2 does not necessarily require a unitary structure. The flexible material preferably is selected such that the bubble gasket 3 can conform to the shape of a surface so that it contacts and return to its undeflected shape when not engaged. In some configurations, a wall thickness of the bubble gasket 3 is smaller than a wall thickness of a portion or an entirety of the profile layer 2. The bubble gasket 3 can be used for sealing of irregularities in a deflection gap in the head-of-wall assembly, as described further below. In some implementations, the bubble gasket 3 can be hollow.

The gasket profile 10 can include the foil lining 15. The foil lining 15 can cover an entire side of the profile layer 2 or only a portion. The foil lining 15 can be formed of a metallic material. For example the foil lining 15 can be formed of a thin sheet of aluminum or other metal. The foil lining 15 can be attached to the profile layer 2. In some implementations, the foil lining 15 can be coupled to and extend across portions of the leg portion 7, the horizontal portion 5, and/or the upper flange 6. In one implementation, the foil lining 15 fully or partially surrounds the air gap 13. Optionally, the foil lining 15 can extend onto the upper flange 6. In other implementations, the foil lining can extend all the way across the horizontal portion 5 and/or the vertical portion 7. If desired, the foil lining 15 could be located on a portion or an entirety of either or both sides of the profile layer 2.

The foil lining 15 can be adhered to the profile layer 2. An adhesive (e.g., a commercially available adhesive) can be used to attach the foil lining to the profile layer 2. For example, the foil lining 15 can be in the form of a tape with a foil lining having adhesive applied on one side thereof. The adhesive of the tape can be coupled to the profile layer 2. For example, the tape can be adhered along the length of the fire-blocking gasket profile 1. The tape can be thin and flexible so the tape can follow the complex shape of profile layer 2. The tape can be applied along portions or the entire length of gasket profile 10. In other arrangements, the foil lining 15 can be applied as part of the extrusion process of the profile layer 2.

The foil lining 15 can have a thickness of between 3 mil to 8 mil. In some embodiments, the foil lining 15 may be thinner than 3 mil or thicker than 8 mil. The foil lining 15 can be thinner than, for example, a layer of 22 gauge steel, which may provide fire protection but also increases build up at the head-of-wall assembly. The use of thinner foil reduces the amount of buildup (e.g., bulk) in a head-of-wall assembly. The use of thinner foil also reduces cost and increases flexibility so that the gasket profile 10 can better conform to imperfect (e.g., non-linear or non-flat) surfaces.

In some embodiments, the foil lining 15 may be replaced by a nonmetal fire- or heat-resistant material, film, fabric (e.g., mineral cloth) or the like. Such a material preferably has a melting temperature higher than the melting temperature of the material from which the profile layer 2 is formed.

The third layer or fire-blocking layer in the gasket profile 10 can be or include the intumescent material strip 17. The intumescent material strip 17 can be coupled to the profile layer 2 or the foil lining 15. The intumescent material strip 17 can be a heat expandable material that is used to seal the head-of-wall assembly. The intumescent material strip 17 can be coupled anywhere along the foil lining 15. For example, the intumescent material strip 17 can be attached to the leg portion 7 and/or the horizontal portion 5, or otherwise located within the air gap 13. For example, the intumescent material strip 17 can be included in a location proximate the corner 8 between horizontal portion 5 and leg portion 7 of the profile layer 2. In some configurations, the foil lining 15 can be located only on one or more of the upper angled portion 20, horizontal portion 5 and the upper flange 6. The intumescent material strip 17 can be located only on the upper angled portion 20. In other implementations, the intumescent material 6 can be attached to the upper flap 6.

The intumescent material strip 17 can be adhered to the foil lining 15. For example the intumescent material strip 17 can be in a form of a tape with a strip of intumescent material having an adhesive on one side thereof. The tape can be adhered along the length of the gasket profile 10.

Figure 2:
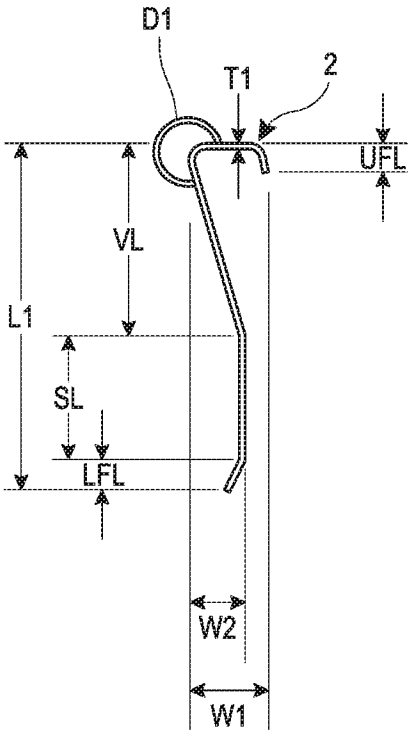
FIG. 2 illustrates a profile of the fire-blocking gasket profile of FIG. 1.

FIG. 2 illustrates exemplary dimensions of the profile layer 2. Certain implementations of the profile layer 2 can vary even greatly from the exemplary dimensions described here. The profile layer 2 can have a width W1. The width W1 can be an overall width of the profile layer 2 without the bubble gasket 3. The width W1 can correspond to the length of the horizontal portion 5. The width W1 can be approximately 0.375". In other implementations, the width W1 can be between 0.125" and 1".

The profile layer 2 can include a width W2. The width W2 can correspond to a width of the leg portion 7 of the profile layer 2. The width W2 can be approximately 0.25". The profile layer 2 can include an overall length L1. The overall length L1 can be an overall length of the leg portion 7 of the profile layer 2. The overall length L1 can be between 1" and 3" such as about 1½" or 1⁹⁄₁₆". The air gap 13 can include a vertical length VL. The vertical length VL of the air gap 13 can be approximately 1". A length SL of the straight length of the fastener location 9 can be approximately 0.5". A length LFL of the lower flange 11 can be approximately 0.25". A length UFL of the upper flange 6 can be approximately 0.5".

A thickness T1 of the profile layer 2 can be approximately 0.0625". The thickness T1 selected based on the material properties of the material of the profile layer 2 and its affected elastic properties thereof. The bubble gasket 3 can have a diameter D1. The diameter D1 can be 0.375". In other implementations, the diameter D1 can be between 0.125" and 1".

In some implementations, the gasket profile 10 does not include the foil lining 15 and/or the intumescent material 17, as illustrated in FIG. 2. For example, the profile layer 2, with or without the bubble gasket 3, can be used within a head-of-wall assembly, as described below.

Figure 3:
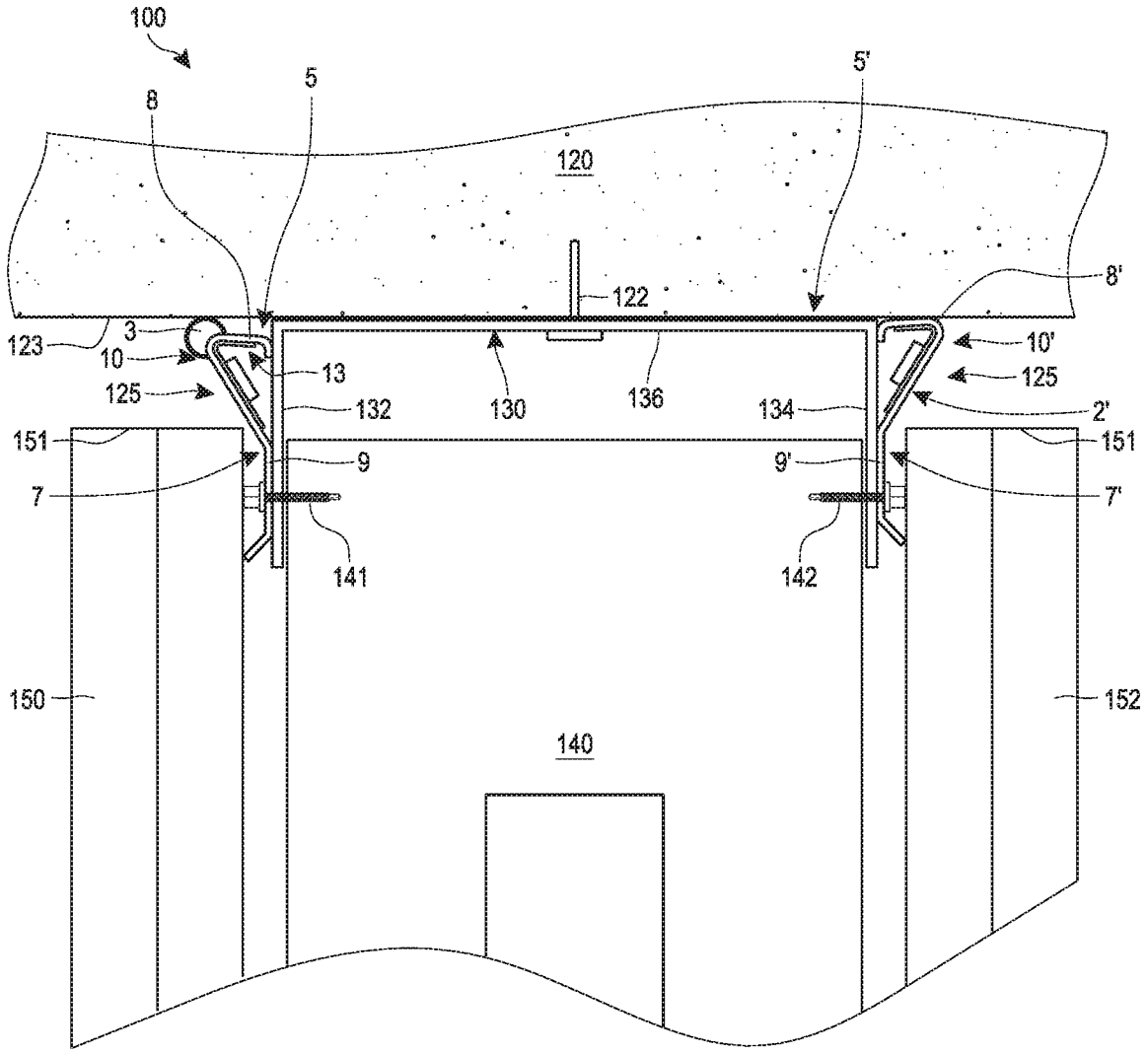
FIG. 3 is a section view of a head-of-wall assembly including the fire-blocking gasket profile of FIG. 1 on a left side and a variation of the fire-blocking gasket profile of FIG. 1 on the right side.

FIG. 3 illustrates a gasket profile 10 installed within a head-of-wall assembly 100. The assembly 100 can include a ceiling 120. The ceiling 120 can be representative of a floor, wall and/or ceiling or other structure. A header track 130 can be coupled with the ceiling 120. For example, a fastener 122 can couple a web portion 136 to the ceiling 120. The header track 130 can include first and second flanges 132, 134. The first and second flanges 132, 134 can extend in parallel from opposite edges of the web 136. An upper end of a stud 140 or a plurality of studs 140 can be disposed within or between the first and second flanges 132, 134. The stud 140 can be coupled with the header track 130 in a manner that allows for a sliding engagement between the header track 130 (e.g., the first and second flanges 132, 134) and the stud 140. For example, the stud 140 can be coupled by a mechanical fastener (e.g., a screw) that passes through a slotted hole within each of the first and/or second flanges 132, 134 and into the stud 140.

A first wallboard 150 (e.g., a gypsum or other board) can be coupled with the stud 140 on a first side of the assembly 100. A second wallboard 152 can be coupled with the stud 140 (or another stud of the plurality of studs) on a second, opposite side of the assembly 100. Optionally, only one wallboard side is in the assembly 100. If desired, multiple wallboard layers can be used on one or both sides of the wall assembly.

The head-of-wall assembly 100 can define a deflection gap 125. The deflection gap 125 can be defined between an upper end 151 of the wallboard 150 (or an upper end 153 of the second wallboard 152) and a lower surface 123 of the ceiling 120. The deflection gap 125 can accommodate dynamic movement of the head-of-wall 100. For example, the stud 140 and wallboards 150, 152 can move in relation to the ceiling 120 and the header track 130. As described above, this can accommodate movement of the ceiling 120 with respect to the stud 140 and wallboards 150, 152 (e.g., due to earthquake or movement of the building).

The fire-blocking gasket profile 10 can be installed within the deflection gap 125. The gasket profile 10 can be provided on one or on both sides of the assembly 100. The leg portion 7 can be coupled with the first flange 132 of the header track 130 (e.g., between the first flange 132 and the wallboard 150). A fastener 141 can couple the fastener location 9 against the first flange 132. The straight segment of the fastener location 9 can be flush against the first flange 132. Preferably, the fastener 141 is positioned between studs 140 of the stud wall so that the studs 140 are permitted to move up and down relative to the header track 130.

In practice, the studs 140 can be installed within the header track 130 and then the fire-blocking gasket profile 10 can be attached to the header track 130. Subsequently, the wallboard 150 can be installed with the upper end 151 at least partially overlapping the leg portion 7 of the gasket profile 10. The lower flange 11 can be flared outwards (e.g., towards the wallboard 150). In some implementations, the lower flange extents outward farther than the fastener 141. The lower flange 11 can sealingly engage with the wallboard 150. The wallboard 150 can elastically deflect the lower flange 11 such that the lower flange 11 exerts a sealing force against the wallboard 150. This sealing engagement can seal against the passage of smoke and/or noise across the head-of-wall assembly 100. The lower flange 11 can also be referred to herein as a "kick-out."

Portions of the horizontal portion 5, the upper flap 6 and/or the bubble gasket 3 can fit adjacent to or within the deflection gap 125. The gasket profile 10 can thereby provide a seal against noise and/or sound across the deflection gap 125. For example, the bubble gasket 3 can sealingly engage with the upper surface 123. The flexible material of the bubble gasket 3 provides the advantages of conforming to and sealing against the upper surface 123 even where the upper surface is uneven and/or irregular. The gasket profile 10 can include a protruding contoured portion that extends into the deflection gap 125. The contoured portion can include the bubble gasket 3, corner 8, and/or horizontal and leg portions 5, 7. In some configurations, a sound-blocking gasket profile 10 is provided that omits the intumescent material strip 17 and/or the foil lining 15. Such an arrangement can be manufactured for a lower cost than a version incorporating fire-blocking material and is well-suited for use to reduce sound transmission through the head-of-wall gap when fire-rating is not required or when another means for fire-rating is used.

FIG. 3 also illustrates a variation of the gasket profile 10. A second gasket profile 10' is shown installed on the right side of the assembly 100 within the deflection gap 125 (e.g., between the upper end 153 of the second wallboard 152 and the upper surface 123). The gasket profile 10' can include the same structure as the gasket profile 10 (e.g., a horizontal portion 5', a leg portion 7', etc.), except the gasket profile 10' does not include a bubble gasket 3. A horizontal portion 5' and/or a corner 8' can sealingly engage with the upper surface 123.

The gasket profile 10 can be assembled within the head-of-wall assembly 100 with an opening of the air gap 13 facing towards the header track 130. The air gap 13 may be formed by the contoured portion or protrusion along an upper portion of the profile layer 2. The protrusion extends in a direction away from the header track 130. The air gap 13 provides clearance in the assembly 100 that allows a thermocouple (TC) used in UL testing to be placed further away from the leg of the header track 130. The increased distance away from the header track 130 can reduce the overall surface temperature measured by the TC. Thus, the air gap provides a buffer to reduce surface temperature of the profile layer 2 and by lowering the surface temperature it allows the profile to pass the UL test that requires the TC to be placed against a surface within the deflection gap 125.

The orientation of the air gap 13 towards header track 130 also provides the advantage of shielding and protecting the intumescent material strip 17 within the air gap 13 from an exterior of the head-of-wall assembly 100. The air gap 13 offsets the intumescent strip from the header track 130. By offsetting the intumescent material strip 17 out of direct contact from the header track 130 and/or locating it within the air gap 13, the temperature of the intumescent strip can rise more slowly. Thus, the intumescent material strip 17 can expand later or at a slower rate than it otherwise would in contact with the header track 130. Also, the intumescent material strip 17 can be protected from contact with the moving wallboard 150, 152 during cycling of the head-of-wall assembly 100.

In contrast, a track with a vinyl profile having intumescent material attached in direct contact with a header track may have difficulty passing UL-2079 testing or other relevant fire tests or standards. This can be because of the lack of an air gap or other insulation gap. Furthermore, when the intumescent material expands on the cold side of the wall (i.e., the side of the wall opposite to where the fire is located), the vinyl of the profile may melt, give way and allow the intumescent material to expand outwardly through the vinyl, causing the thermocouple (TC) which is now in contact with the intumescent to record the high temperature of the expanding intumescent. In other words, the vinyl profile melts away and exposes the intumescent material. The outwardly expanding and less dense exposed intumescent on the cold side will allow too much heat exposure and will exceed the threshold temperature measured by the TC and cause the UL test to fail. Furthermore, it is possible that the outwardly-expanding intumescent material could fall out of the deflection gap 12. As a result, in some circumstances, the vinyl DDA without foil may be less desirable.

FIG. 3 illustrates the head-of-wall assembly 100 in an open position of the deflection gap 125. In the open position, the upper flange 6 can slidingly engage with the header track 130. The engagement of the upper flange 6 can position the horizontal portion 5 and/or other portions of the profile layer 2 into the deflection gap 125. This can create the air gap 13 and/or offset the intumescent strip 15 from the header track 130.

Figure 4:
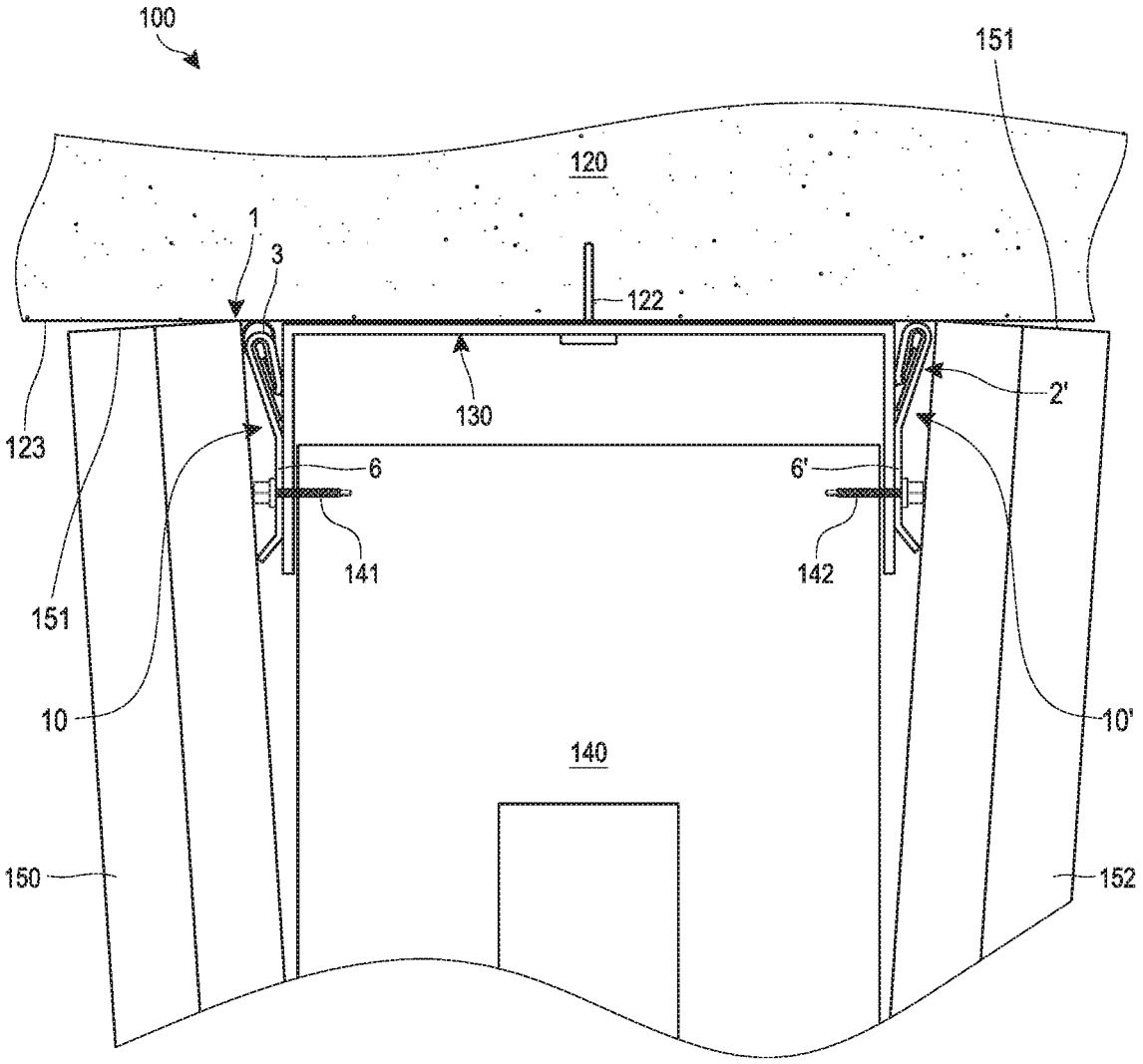
FIG. 4 illustrates the head-of-wall assembly of FIG. 3 in a closed position with the deflection gap reduced compared to FIG. 3 or completely closed.

FIG. 4 illustrates the head-of-wall assembly 100 in a closed position with the deflection gap 125 closed. In the closed position, the gasket profile 10 is compressed into a flat or relatively flat configuration in comparison to its relaxed position with no flattening forces present. The assembly 100 can cycle between the open and closed positions and the gasket profile 10 can correspondingly expand toward or to the relaxed position and compress toward or to the flat configuration. The gasket profile 10 can seal across the assembly 100 in both the open and closed positions. For example, the bubble gasket 3 can remain sealingly engaged with the upper surface 123 in both the expanded and flat configurations. Similarly, the profile layer 2' of gasket profile 10' can be sealingly engaged in both expanded and flat configurations. Advantageously, the expanding of the gasket profile 10, 10' when the deflection gap 125, 125' opens reestablishes or enlarges the size of the air gap 13, 13'.

The material of the profile layer 2 can provide an elastic reaction to expand the gasket profile 10 into an expanded configuration, as shown in FIG. 3. In the flat configuration, the horizontal portion 5 and the upper flange 6 can fold with respect to the leg portion 7 to partially or fully collapse the air gap 13. To transition into the flat configuration, the upper flange 6 can slide downwards along the first flange 132 of the header track 130. This ensures that the gasket profile 10 can fold toward or into the flat configuration and avoid being crushed within the assembly 100. To transition into the expanded configuration, the upper flange can slide upwards along the first flange 132 to expand the air gap 13.

Figure 5:
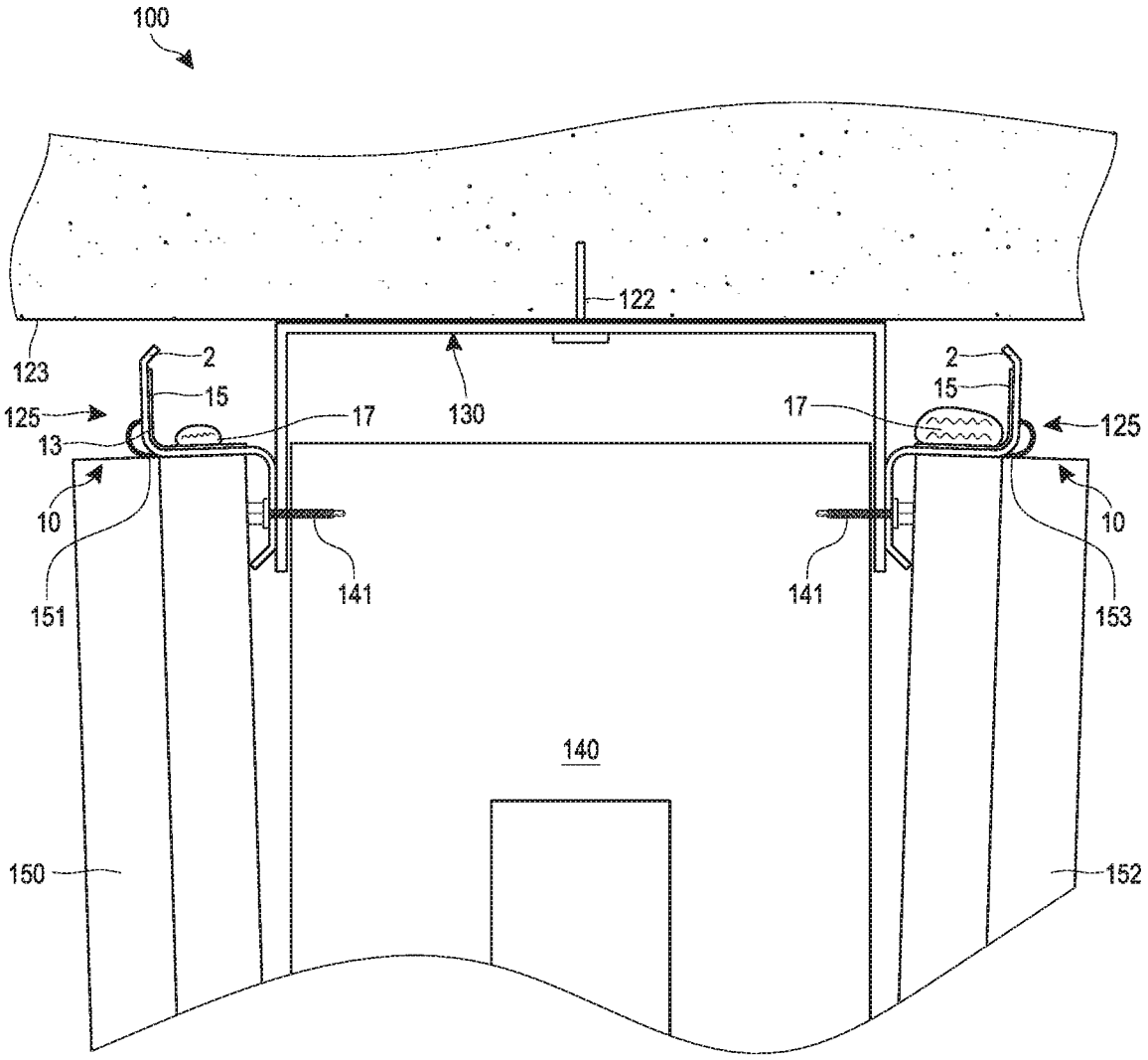
FIG. 5 illustrates the head-of-wall assembly of FIG. 3 showing the collapse of the fire-blocking gasket profiles or tracks on each side to facilitate or provide for primarily vertical (upward) expansion of an intumescent material of the tracks. An initial state of expansion of the intumescent material of the fire-blocking gasket profile on the left side and a further state of expansion on the right side.
Figure 6:
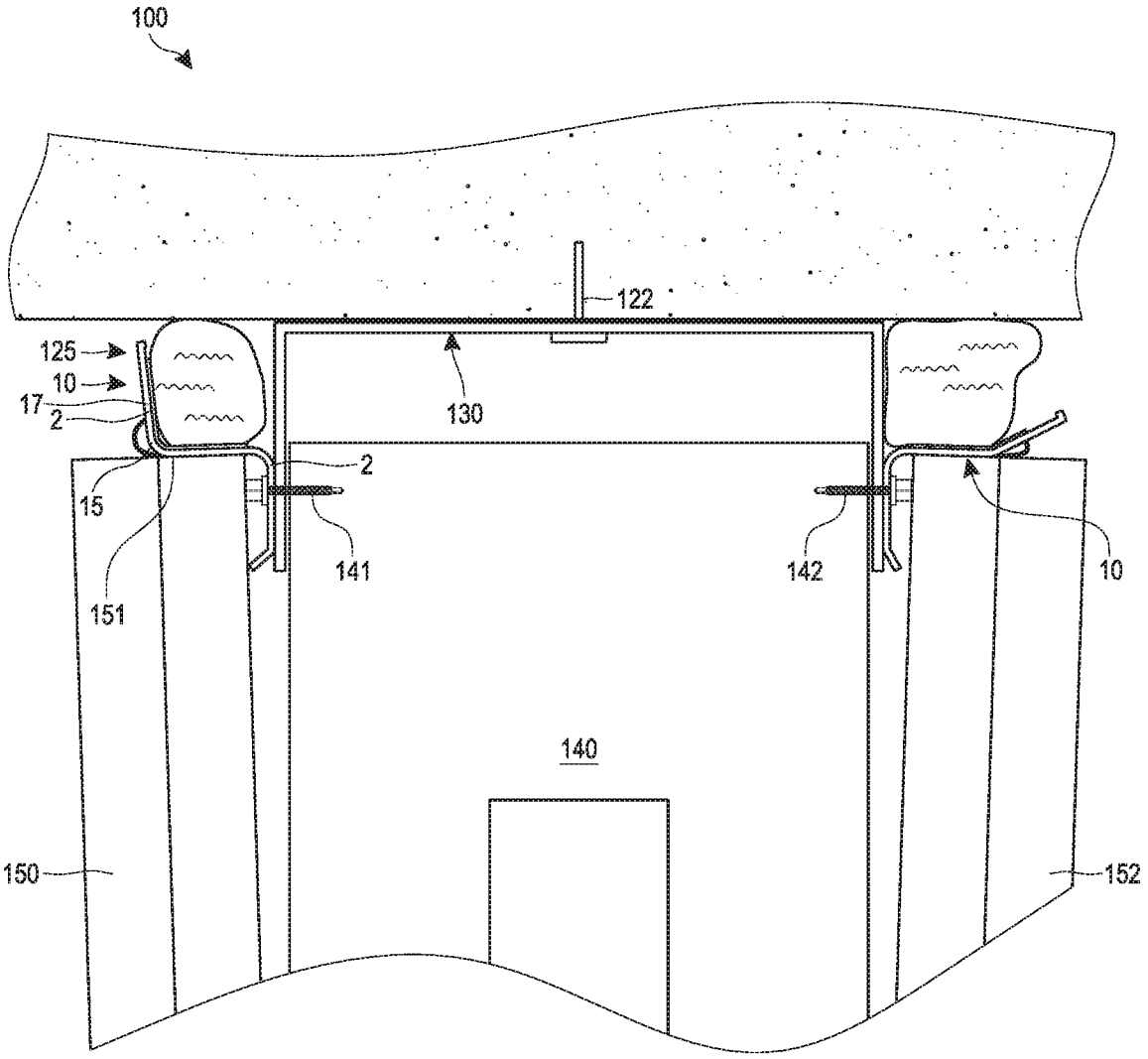
FIG. 6 illustrates the head-of-wall assembly of FIG. 3 showing the intumescent material in progressively further states of expansion from the left side to the right side.

FIGS. 5-6, moving left to right, show the function of the gasket profile 10 when exposed to heat, such as a fire. The gasket profile 10 can be designed such that the material of the profile layer 2 can melt when exposed to heat. For example, the vinyl, plastic, or other material has a low melting point relative to the other materials of the assembly 100 (e.g., gypsum, wood, metal). When melted or at least partially softened, the portions of the profile layer 2 surrounding the air gap 13 of the gasket profile 10 can collapse into the deflection gap 125 and preferably toward the upper ends 151, 153 of the wallboard 150, 152.

Generally, the initiation (e.g., expansion) temperature of the intumescent material strip 17 is approximately 350° F. Vinyl begins to melt and lose form at approximately 350° F. Vinyl eventually dissipates at approximately 500° F. However, when used, foil dissipates at approximately 1200° F. Accordingly, as the temperature within the assembly 100 rises above the melting temperature of the material of the profile layer 2 (e.g., vinyl), the portion of the gasket profile 10 that has the foil lining 15 can stay intact (i.e., not melted or dissipated). That is, the foil lining 15 does not melt immediately to expose the intumescent material strip 17.

With or without the foil layer 15, the collapse of the gasket profile 10 into the deflection gap 125 offsets the intumescent material from the header 130 and/or other components of the assembly 100. This can slow the heating and therefore the expansion of the intumescent material strip 17. This provides the advantages of a more controlled and/or denser expansion leading to a better seal across the deflection gap 125. The expansion of the intumescent material strip 17 can also be slowed by the air gap 13.

Collapse of the profile layer 2 during a fire can also orient the intumescent material strip 17 to expand vertically upward to seal off the deflection gap 125 instead of outward, as would be the case without collapse of the profile layer 2. The intumescent material strip 17 can be bounded by the ceiling structure 120 and the upper end 151, 153 of the wallboard 150, 152, which causes the expanding intumescent to avoid overexpansion and maintain density as it expands. The density of the intumescent material improves the fire/smoke protection within the deflection gap 125. The expansion process can take up to 20 minutes before the deflection gap 125 is fully sealed.

The optional foil lining 15 positioned between the profile layer 2 and the intumescent material strip 17 provides integrity to the assembly 100 during a fire. The foil lining 15 acts as an insulating or protective layer for the intumescent material strip 17. Further, the foil lining 15 will maintain structural integrity of the gasket profile 10 such that the position of the intumescent material strip 17 is maintained within the deflection gap 125 and the expanding intumescent material 15 within the deflection gap 125 can be at least partially contained. That is, even if the profile layer 2 loses form and/or melts away, the foil lining 15 will not melt and prevent the expanding intumescent material strip 17 from falling out of the deflection gap 125 and/or expanding in an undesirable direction (e.g., outward, which could permit overexpansion). Accordingly, because the foil lining 15 does not melt, the intumescent material strip 17 is contained and will maintain as a concentrated mass which will maintain the intumescent material strip 17 within the deflection gap 125. However, if there is no containment, the intumescent material 125 could continue to expand and lose its concentrated mass thereby reducing its effectiveness to block heat. While the foil lining 15 may provide extra protection from dislodgment of the intumescent material strip 17, it is not necessary in all applications and may be omitted to reduce costs.

FIG. 5, at left, illustrates the initial collapse of the profile layer 2 into the deflection gap. The intumescent material strip 17 remains attached to the foil lining 15 (or profile layer 2 if the foil lining 15 is omitted). As the temperature across the assembly 100 increases from the heat, the material of the profile layer 2 will begin to melt and eventually dissipate. However, the foil lining 15 (or remaining portion of the profile layer 2) maintains the intumescent material strip 17 within the deflection gap 125 and oriented for vertical expansion.

FIG. 5, at right, illustrates the initial expansion of the intumescent material strip 17. The intumescent material strip 17 is at least partially retained within the deflection gap 125 and is oriented such that the primary direction of expansion is vertically upward. Portions of the profile layer 2 can begin to dissipate from the heat; however, the foil lining 15 remains intact and secures the intumescent material strip 17 in place within the deflection gap 125.

FIG. 6, at left, illustrates the further expansion of the intumescent 17. The material of the profile layer 2 can be further dissipated. The foil lining 15, having a higher melting temperature or dissipation temperature, can at least partially remain after the melting or dissipation of the profile layer 2. FIG. 6, at right, illustrates the final expansion of the intumescent material strip 17. The intumescent material strip 17 fully seals across the deflection gap 125. Undissipated portions of the foil lining 15 and/or the profile layer 2 can remain. The increasing temperatures can also expand the intumescent material strip 17 into an expanded state. In the expanded state, the intumescent material can seal the deflection gap 125 against smoke, heat, fire and other material passing through the head-of-wall assembly 100.

Figure 8:
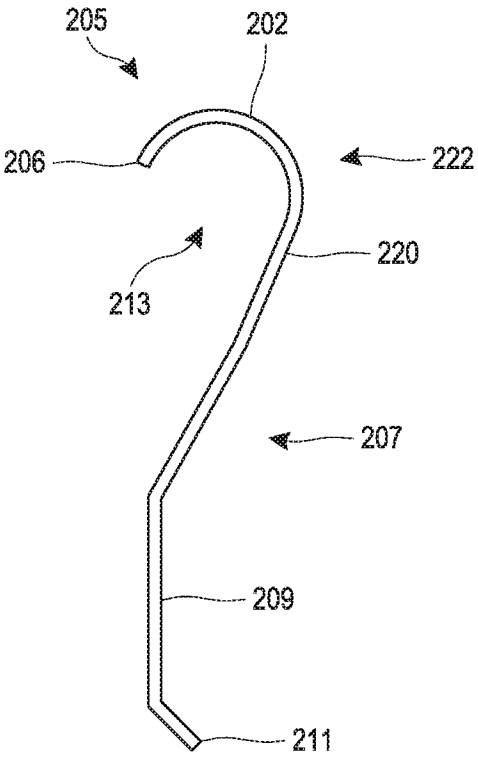
FIG. 8 shows a profile of the fire-blocking gasket profile of FIG. 7.
Figure 7:
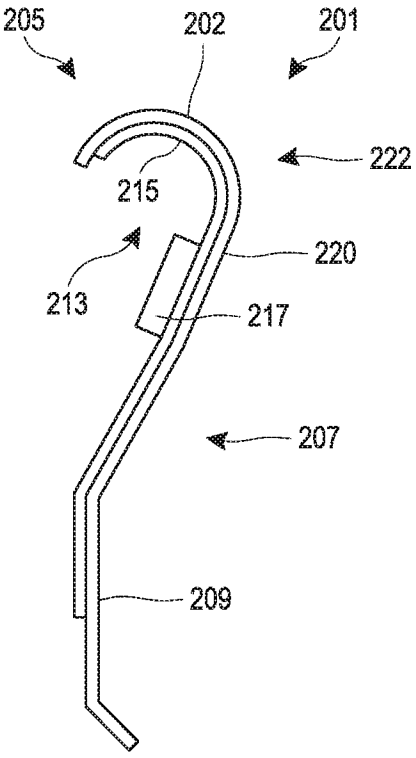
FIG. 7 illustrates a fire-blocking gasket profile according a second embodiment.

FIGS. 7-8 illustrate a second embodiment of a fire-blocking component, in the form of a gasket profile 201. In certain implementations, the gasket profile 201 can be formed in various lengths (e.g., 5', 10', 12' or other) each preferably having the same cross section throughout. The gasket profile 201 can be used in the assembly 100, similar to the fire-blocking gasket profile 10. The fire-blocking gasket profile 201 can include a profile layer 202. The profile layer 202 can include a generally horizontal portion 205 and a leg portion 207. The profile layer 202 can include a fastening location 209. The fastening location 209 can be coupled with a lower flange 211. Similar to the component 10, the fastening location 209 of the component 201 can be referred to as or can form a planar lower portion. An upper angled portion 220 and the generally horizontal portion 205 form a non-planar upper portion 222, which partially or fully defines an air gap 213. The upper angled portion 220 can be a first portion of the non-planar upper portion and the generally horizontal portion 205 can be a second portion, which can be or include a curved section.

The air gap 213 can be located between portions of the horizontal portion 205 and the leg portion 207. An optional foil lining 215 can be coupled to at least portions of the horizontal portion 205 and the leg portion 207. The foil lining 215 can at least partially surround the air gap 213. An optional intumescent material 217 can be coupled with the foil portion 217. The intumescent material 217 can be located within the air gap 213. The functionality of the gasket profile 201 is substantially similar to the profile 10; however, the gasket profile 201 has a more rounded horizontal portion 205 and transition between the horizontal portion 205 and the upper portion of the leg portion 207.

In some implementations, the gasket profile 201 does not include the foil lining 215 and/or the intumescent material 217, as illustrated in FIG. 8. For example, the profile layer 202 can be used within a head-of-wall assembly.

Figure 10:
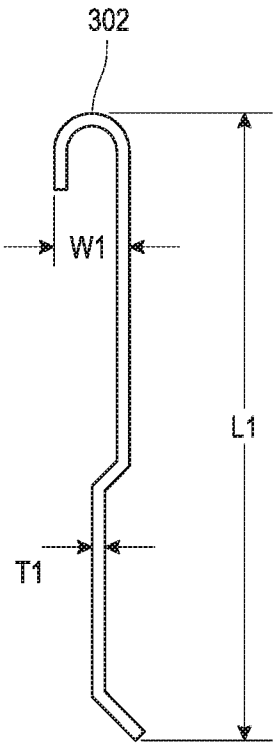
FIG. 10 shows a profile of the fire-blocking gasket profile of FIG. 9.
Figure 9:
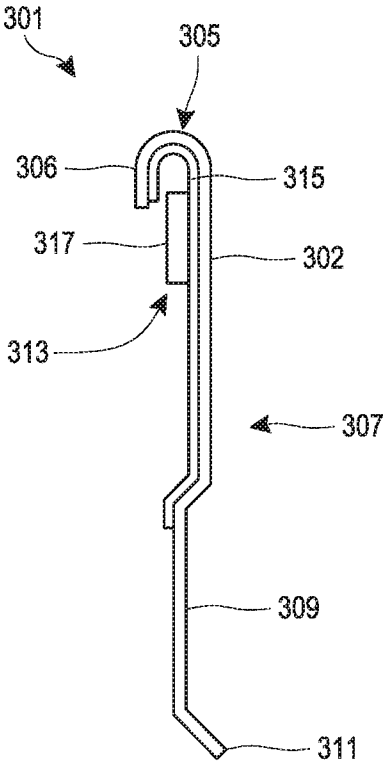
FIG. 9 shows a fire-blocking gasket profile according to a third embodiment.

FIG. 9-10 illustrate a third embodiment of a fire-blocking component, in the form of a gasket profile 301. The gasket profile 301 can be used in the assembly 100, similar to the fire-blocking gasket profile 10. In certain implementations, the gasket profile 301 can be formed in various lengths (e.g., 5', 10', 12' or other) each preferably having the same cross-sectional shape throughout. The fire-blocking gasket profile 301 can include a profile layer 302. The profile layer 302 can include a generally horizontal portion 305. The horizontal portion 305 can be connected to an upper flange 306. A leg portion 307 of the profile layer 302 can extend downwardly from the horizontal portion 305 and can include a fastening location 309. The fastening location 309 can connect to a lower flange 311. An air gap 313 can be defined between at least portions of the horizontal 305 and the leg portion 307 of the profile layer 302. In the illustrated arrangement, at least an upper angled portion of the leg portion 307 and the horizontal portion 305 (optionally, and the upper flange 306) form a non-planar upper portion that partially or fully defines the air gap 313.

A foil lining 315 can be disposed on one side of the profile layer 302. The foil lining 315 can at least partially surround the air gap 313. An intumescent material 317 can be attached to the foil lining 315. The intumescent material 317 can be located within the air gap 313. The profile layer 302 can have an overall length L1 between approximately 1.0-4.0", although this range is not required. The profile layer 302 can have an overall width W1 of between approximately 0.375"-1.125", although this range is not required. The profile layer 302 can have a thickness T1 of between approximately 0.0625"-0.125", although this range is not required.

In some implementations, the gasket profile 301 does not include the foil lining 315 and/or the intumescent material 317, as illustrated in FIG. 10. For example, the profile layer 302 can be used within a head-of-wall assembly.

Figure 11:
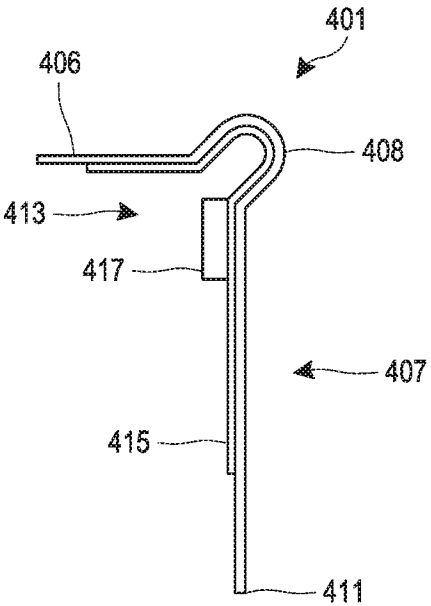
FIG. 11 shows a fire-blocking gasket profile according to a fourth embodiment.

FIG. 11 illustrates another embodiment of a fire-blocking component, in the form of an angle or gasket profile 401. The gasket profile 401 can be used in the assembly 100, similar to the fire-blocking gasket profile 10. In certain implementations, the gasket profile 401 can be formed in various lengths (e.g., 5', 10', 12' or other) each preferably having the same cross-sectional shape throughout. Fire-blocking gasket profile 401 can include a profile layer 402. The profile layer 402 can include an upper flange 406 and a leg portion 407. The leg portion 407 can be coupled with the upper flange 406 by a bubble 408. The bubble 408 can be of the same material as the profile layer 402 or a different material (e.g., co-extension, adhered, or mechanically fastened together). At the lower end of the 411 of the leg portion 407 can include a fastening location. The upper flange 406 can be configured to be installed within a head-of-wall assembly between a header track 130 and the ceiling 120. For example it can be installed and held in place by friction. The lower portion 411 can be installed between the wall board 150 and the header track 130.

Figure 12:
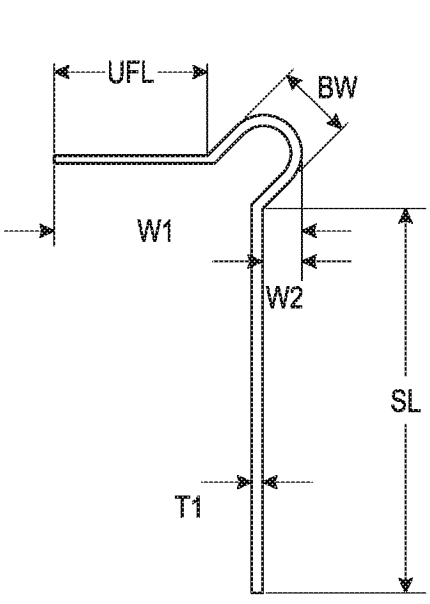
FIG. 12 shows a profile of the fire-blocking gasket profile of FIG. 11.

The gasket profile 401 can include a foil lining 415. The foil lining 415 can extend across portions of the vertical portions 407, the bubble 408, and/or the upper flange 406. An intumescent material 417 can be coupled with the foil lining 415. The bubble 408 can sealingly engage with the ceiling of 120. The upper flange 406 can optionally be slidingly engaged with the header track 130 to bias the track 400 such that a bulged portion (e.g., of the leg portion 407 and the bubble 408, and the horizontal portion 405) extend into the deflection gap 125. In some implementations, the gasket profile 401 does not include the foil lining 415 and/or the intumescent material 417, as illustrated in FIG. 12. For example, the profile layer 402, with or without the bubble 408, can be used within a head-of-wall assembly.

Figure 13:
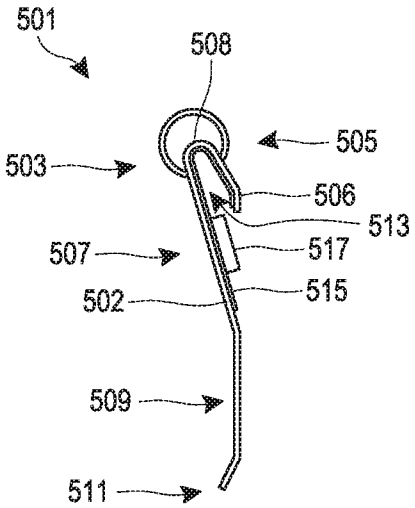
FIG. 13 shows a fire-blocking gasket profile according to a fifth embodiment.

FIG. 13 illustrates another embodiment of a fire-blocking component, in the form of a gasket profile 501. The gasket profile 501 can be used in the assembly 100, similar to the fire-blocking gasket profile 10. In certain implementations, the gasket profile 501 can be formed in various lengths (e.g., 5', 10', 12' or other) each preferably having the same cross section throughout. Fire-blocking gasket profile 501 can include a profile layer 502. The profile layer 502 can include an upper portion 505 and a leg portion 507. An air gap 513 can be at least partially enclosed by the upper portion 505 and the leg portion 507. The upper portion 505 can include a spring flange 506. The profile layer 502 can have any or all of the other portions or sections as described in connection with the profile 10 of FIGS. 1 and 2.

The leg portion 507 includes a fastening location 509. In one implementation, the fastening location 509 includes a flat segment. The flat segment can be configured to be pressed in contact with a header track, such as the header track 130 described above. The fastening location 509 can be configured to receive at least one fastener to couple the gasket profile 501 with the header track. In one implementation, the spring flange 506 is parallel to and/or aligns with (e.g., is within the same plane as) the fastening location 509 (e.g., the straight portion thereof). This facilitates assembly of the gasket profile 501 against the header track. Moreover, the spring flange 506 can engage with the header track and act as a spring (e.g., along the horizontal portion 505) to bias the air gap 513 into an open configuration.

The leg portion 507 can be coupled with the upper portion 505 at a corner 508. The gasket profile 501 can include an optional bubble gasket 503. The bubble gasket 503 can be of the same material as the profile layer 502 or a different material (e.g., co-extension, adhered, or mechanically fastened together with the profile layer 502). The bubble 503 can sealingly engage with a ceiling, such as the ceiling 120.

The leg portion 507 can include a lower flange 511. The lower flange 511 can be flared outward (e.g., towards the left or away from the fastening location 509). The lower flange 511 can be configured to engage with a wallboard (such as the wallboard 150) of a head-of-wall assembly. The lower flange 511 can prevent or diminish the passage of sound or smoke across the head-of-wall assembly by engagement with the wallboard. The lower flange 511 can also be referred to herein as a "kick-out."

Figure 14:
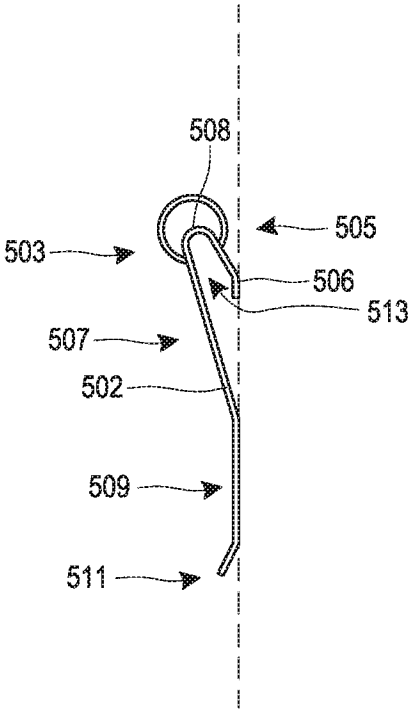
FIG. 14 shows a profile of the fire-blocking gasket profile of FIG. 13.

The gasket profile 501 can include an optional foil lining 515. The foil lining 515 can be located within the air gap 513. The foil lining 515 can extend across portions of the vertical portion 507 and/or the upper portion 505 (e.g., around the air gap 513). The foil lining 515 can be adhered to the profile layer 502. An intumescent material 517 can be coupled with the gasket profile 501. The intumescent 517 can be coupled with the foil lining 515, within the air gap 513 or otherwise coupled with the profile layer 502. In some implementations, the gasket profile 501 does not include the foil lining 515 and/or the intumescent material 517, as illustrated in FIG. 14. For example, the profile layer 502, with or without the bubble gasket 503, can be used within a head-of-wall assembly.

Figure 15:
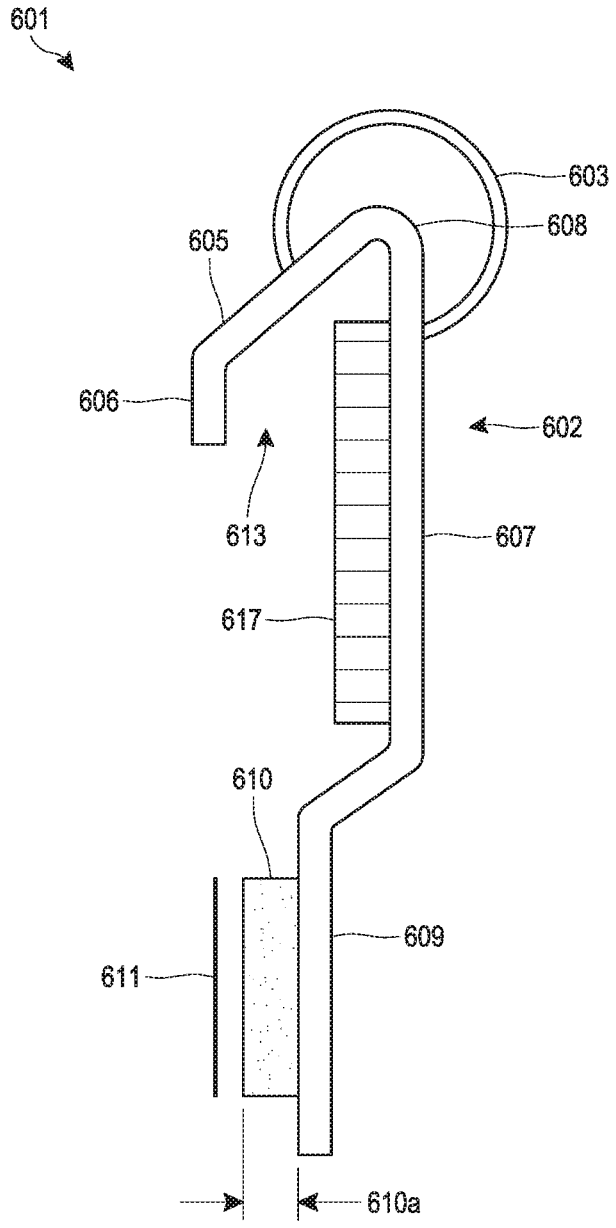
FIG. 15 shows a gasket profile according to a sixth embodiment.

FIG. 15 illustrates another implementation of a gasket profile 601. The gasket profile 601 can be used to fire-block the head of wall assembly 100, as described above. In certain implementations, the gasket profile 601 can be formed in various lengths (e.g., 5', 10', 12' or other) each preferably having the same cross section throughout. The gasket profile 601 can include a profile layer 602. The profile layer 602 can be made out of a vinyl, thin and flexible PVC, rubber, foam, fiberglass, intumescent, or thin sheet metal material or other polymer material. The profile layer 602 can be flexible and pliable to accommodate movement of the assembly 100 (e.g., up and down movement of the wall relative to the ceiling, as described below).

The profile layer 602 can include a leg flange 609. The leg flange 609 can be generally planar. The leg flange 609 lacks a "kick out" flange or outwardly angled lower flange (e.g., lower flange 511). The vinyl profile layer 602 can include a body portion 607, an upper flange 605, and/or a front flange 606. The body portion 607 can be attached to the upper flange 605. The upper flange 605 and the body portion 607 can attach at a bend 608. The body portion 607 and the upper flange 605 can at least partially bound or enclose an inner space or air gap 613. The upper flange 605 can be attached to the front flange 606. The front flange 606 can be generally vertical (e.g., parallel with the leg 132 of the header track 130 and/or the leg flange 609). The profile layer 602 can have any or all of the other portions or sections as described in connection with the profile 10 of FIGS. 1 and 2.

An optional bubble gasket 603 can be attach to or formed as a unitary structure with the profile layer 602. The bubble gasket 603 can be co-extruded with the profile layer 602. The bubble gasket 603 can be formed of a vinyl, rubber, polymer, or other suitable material. The bubble gasket 603 can attach on one end with the upper flange 605 and on a second end with the body portion 607. The bubble portion 603 can be positioned over the bend 608.

The air gap 613 can contain an optional intumescent strip 617. The intumescent strip 617 can be attached to the profile layer 602 (e.g., on the body portion 607). In some implementations, the air gap 613 can include an optional foil lining (not shown), similar to the foil linings described above (e.g., 15, 215, 515). The foil lining can be positioned between the intumescent material 617 and the profile layer 602. The intumescent strip 617 can be attached to the foil lining, if present. The foil lining can be attached to the profile layer 602.

The gasket profile 601 can include a tape 610. The tape 610 can be a foam tape. The tape 610 can be double sided tape. The tape 610 can have first and second sides. The first and second sides can be formed of a fibrous or polymer material. The first and second sides can include an adhesive. The adhesive can attach the tape 610 with the leg flange 609. The tape 610 can include a foam material between the first and second sides. The foam material can be soft to allow the first and second sides to flex relative to each other. This can enhance the sealing properties of the tape 610. The tape 610 can be factory applied to the profile 602.

A first side of the tape 610 can be attached to the profile layer 602. The first side of the tape 610 can be attached to the lower leg 609. A second side of the tape 610, opposite the first side, can include a covering, such as a release paper 611. The release paper 611 can be a wax paper, plastic, or other material. The release paper 611 can be removable from tape 610. Removing the release paper 611 can expose adhesive of the tape 610. In one implementation, the tape 610 can have a thickness 610*a* of approximately 0.125 inches. In other implementations, the thickness 610*a* can be within a range of 0.001 inches up to 0.25 inches. In other implementations, the tape 610 can be thicker.

Figure 16A:
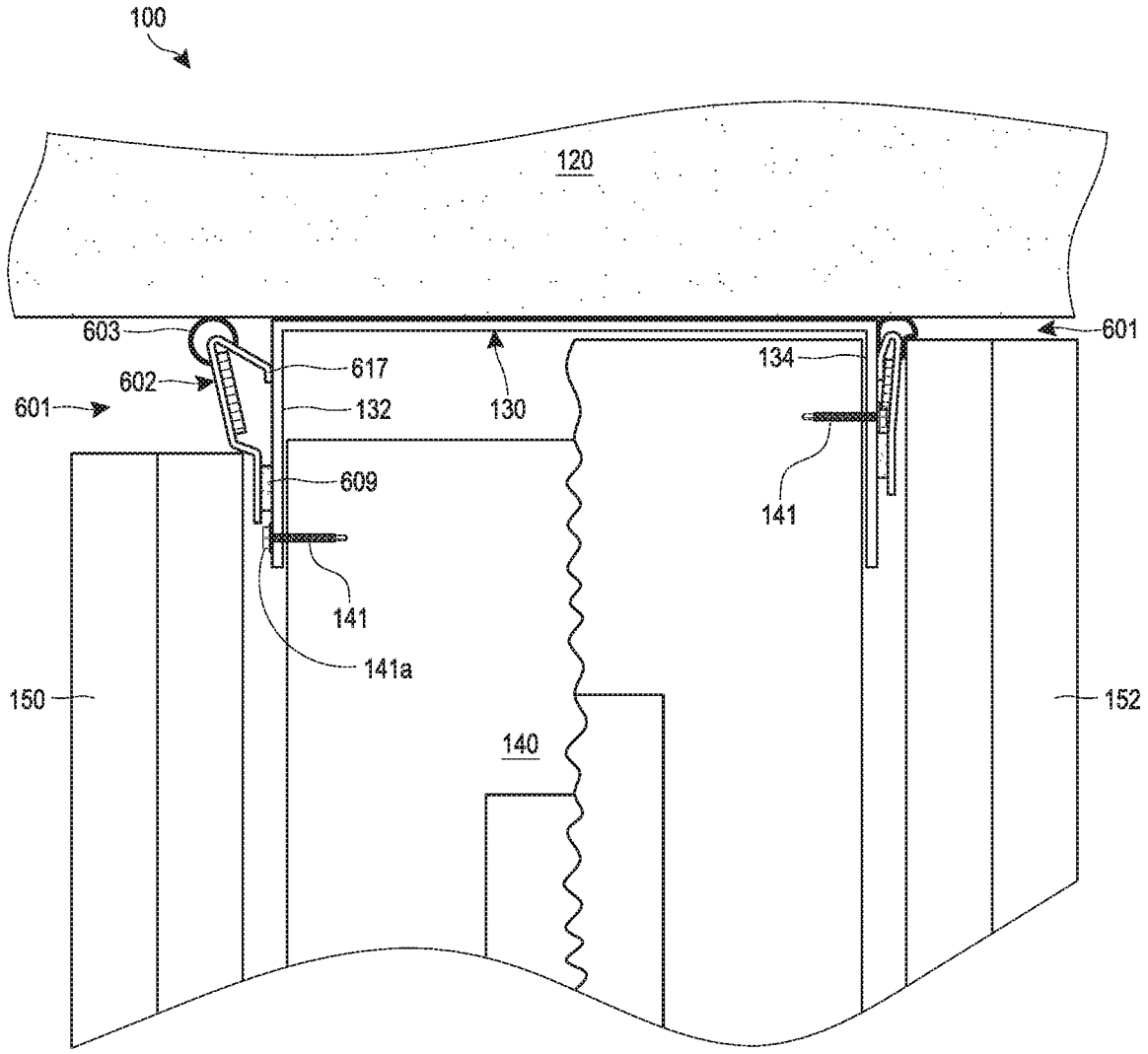
FIG. 16A shows a head of wall assembly with the sixth embodiment of the gasket profile.
Figure 16B:
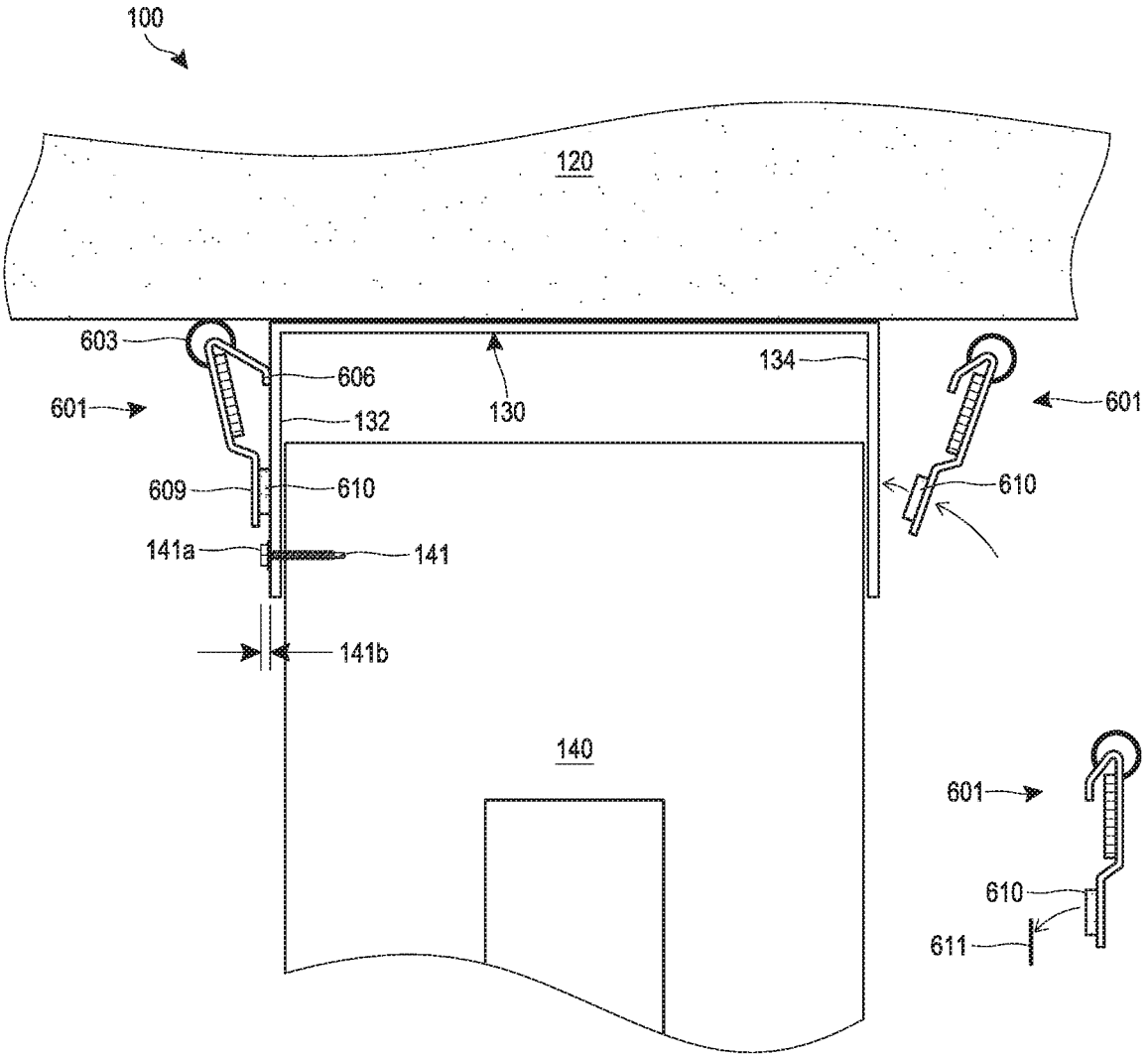
FIG. 16B shows a head of wall assembly with the sixth embodiment of the gasket profile.

The gasket profile 601 can be positioned within the head of wall assembly 100 as shown in FIGS. 16A-B. As shown in the right of FIG. 16B, the release paper 611 can be removed from the tape 610. The gasket profile 601 can then be assembled with the head of wall assembly by attaching the tape 610 with the leg 134 of the header track 130. The gasket profile 601 can be applied to the leg 134 of the track 130 with no mechanical attachment. The tape 610 can provide a seal between the leg flange 609 and the leg 134. The bubble gasket 603 can seal against the ceiling 120, as described above in other implementations. The bubble gasket 603 can provide a compressible seal against the ceiling 120. It is advantageous to provide a compressible seal against the ceiling 120. The compressible seal can allow for movement at the overhead structure. The wall (e.g., studs 140 and wallboards 150) can move independent of the overhead structure (e.g., ceiling 120); the bubble gasket 603 can allow this type of movement while maintaining a seal.

Using the tape 610 can have advantages over attaching the gasket profile 601 using mechanical fasteners (e.g., framing screws). Attaching any gasket profile within a head of wall assembly using framing screws can provide an airtight seal in the vicinity of the framing screw. However, in areas of the gasket between framing screws, the gasket profiles may not provide an airtight seal, which can possibly reduce the effectiveness of blocking sound. The bubble gaskets and other parts of the profile layer can sag within the head of wall assembly 100. For example, the bubble gaskets and similarly structured components can sag away from the ceiling 120. In another example, the profile layers can separate from the header track 130. Accordingly, the tape 610 can improve the sealing capacity of the gasket profiles across the head of wall assembly 100 by providing a more uniform seal than the seal available using mechanical fasteners alone. The tape 610 can provide a tight seal along the entire length of the gasket profile 610. The tape 610 can also provide an insulating factor that can increase the STC (Sound Transmission Class) sound ratings. The tape 610 can provides an air tight seal against the leg 134 of the header track 130. It is advantageous to provide a tight seal against the entire length of the leg 134 of the framing member that cannot move once installed. This seal can prevent or substantially prevent any smoke or sound from passing under the gasket profile 610 or through the slots of the header track 130.

Figure 17:
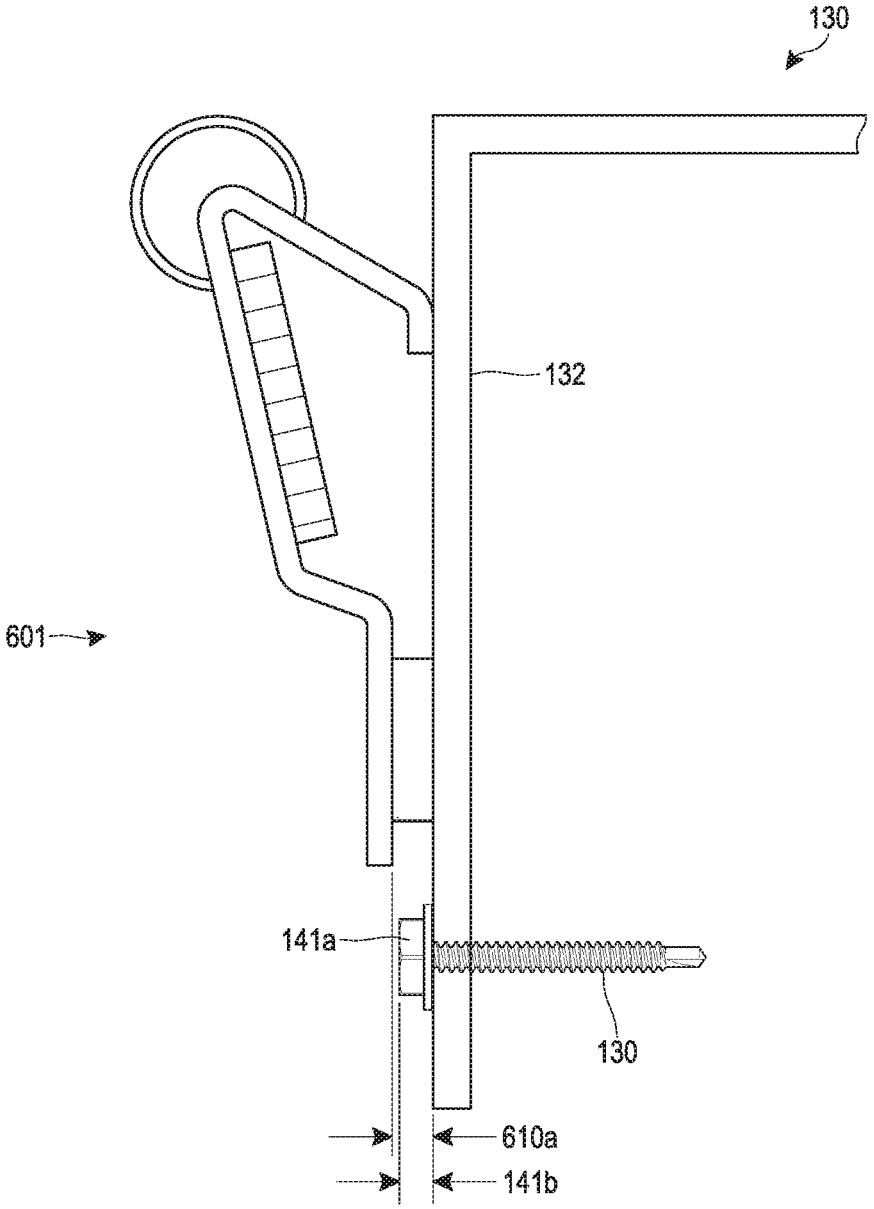
FIG. 17 shows the connection of the sixth embodiment of the gasket profile to a header track.

The leg flange 609 can be attached to the leg 132 of the header track 130, as shown further in FIG. 17. The tape 610 can space the leg flange 609 away from the leg 132. The tape 610 and/or leg flange 609 can provide a spacing for a head 141*a* of a fastener 141 (e.g., screw) that attaches the stud 140 with the header track 130 (e.g., through a slot of the header track 140). The head 141*a* can protrude a distance 141*b* from the leg 132 of the header track 130. The tape 610 can have a thickness 610*a*.

A wallboard 150 can be assembled over the leg flange 609, the tape 610 and the fastener head 141*a*. The wallboard 150 can be held away from the header track 130 by the fastener heads 141*a*. FIG. 16A illustrates the assembly 100 in an open configuration on the left and in a closed configuration on the right. As the ceiling 120 and the stud 140 move relative to one another (e.g., between the open and closed configurations), the thickness 610*a* can allow the gasket profile 601 and the wallboard 150 to remain engaged. This positioning reduces or eliminates the need for a kick out of the profile 602, which can allow for closer engagement of the wallboard 150 with the gasket profile 601. The thickness 610*a* can inhibit or prevent the fastener head 141*a* from interfering with the connection of the gasket profile 601 with the header track 130. The thickness 610*a* of the tape 610 can allow the head 141*a* to slide under the profile 602. The spacing 610*a* can be greater than or approximately equal to the distance 141*b* of the head 141*a*. The thickness 610*a* (e.g., thickness of the tape 610) can be approximately equivalent to the distance 141*b* (e.g., see ranges above). The fastener 141 that is placed within the slots of the track 130 can cycle up and down and not be impeded by the profile 602.

Figure 18:
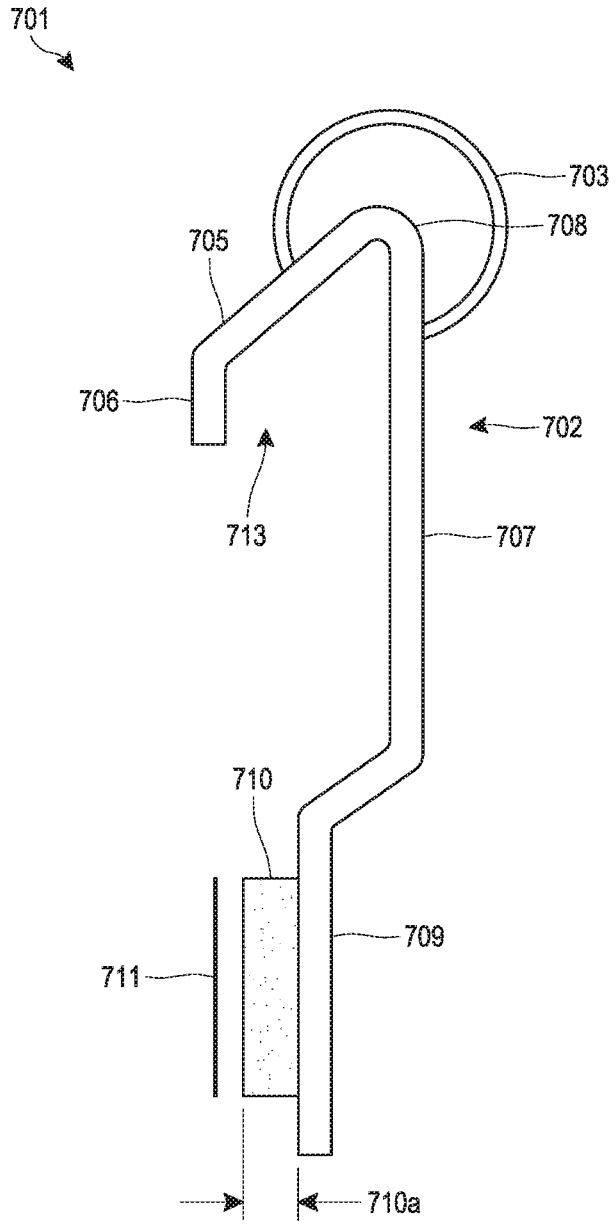
FIG. 18 shows a gasket profile according to a seventh embodiment.
Figure 19:
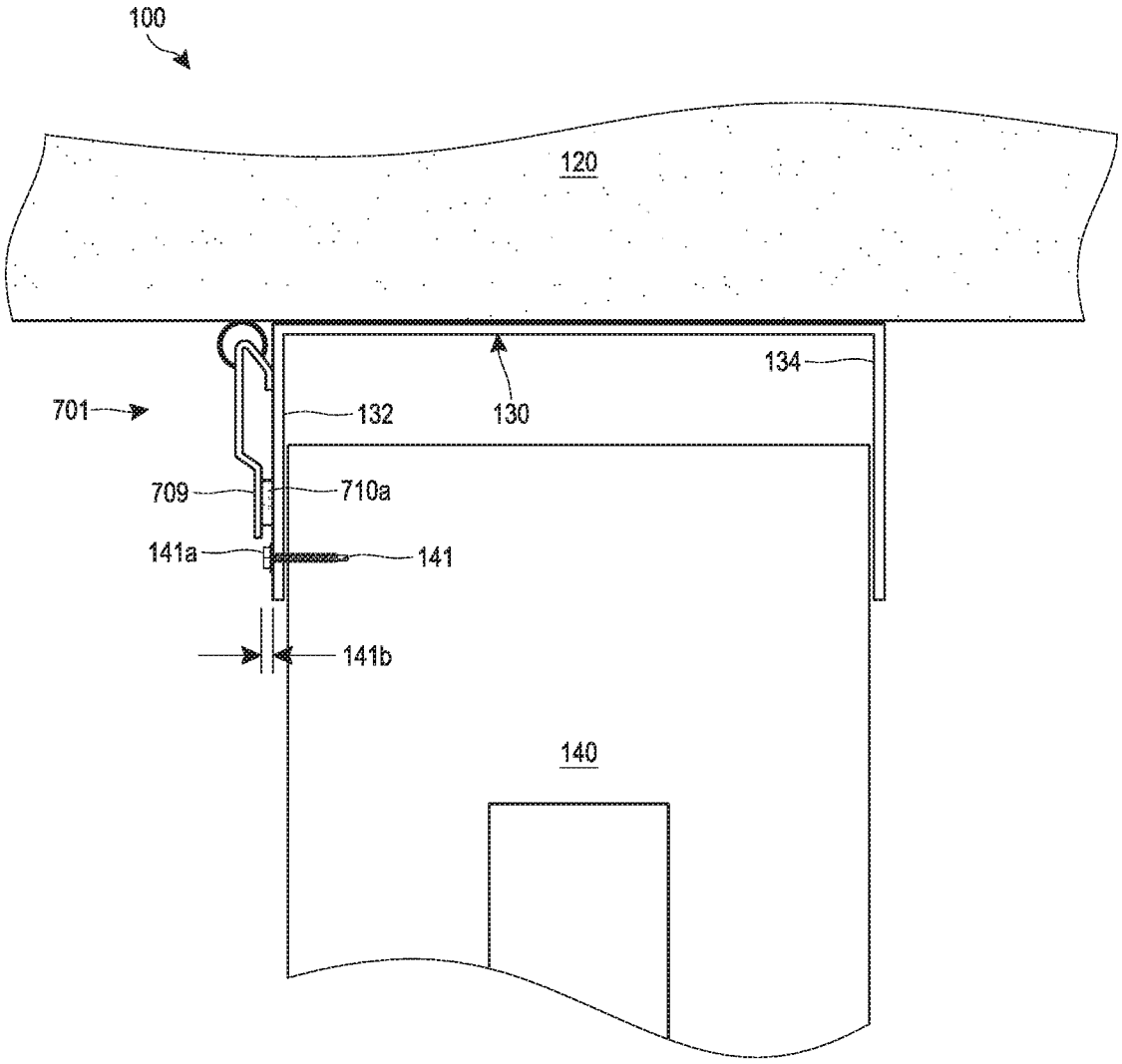
FIG. 19 shows a head of wall assembly with the seventh embodiment of the gasket profile.

FIGS. 18-19 shows another implementation of a gasket profile 701. The gasket profile 701 can be used to sound proof the head of wall assembly 100. The gasket profile 701 can be similar to the gasket profile 601. The gasket profile 701 can be used for sound-proofing of the head of wall assembly 100. The gasket profile 701 can include a profile layer 702, which can include the portions and sections as described in connection with the profile layer 2 of FIGS. 1 and 2. The profile layer 702 can be made of the materials listed above or other suitable material(s). The profile layer 702 can include a front flange 706. Front flange 706 can be attached to an upper flange 705. The upper flange 705 can be attached to a body portion 707. The upper flange 705 and/or the front flange 706 can at least partially enclose an interior space 713. The upper flange 705 can be attached to the body portion 707 at a bend 708. A gasket 703 can be attached to profile layer 702. The gasket 703 can be attached around the bend 708.

The profile layer 702 can include a leg flange 709. The leg flange 709 can attach to a tape 710. The tape 710 can be foam tape. The tape 710 can be double sided tape. One or each of two sides of the tape 710 can include an adhesive material. A first side can attach the tape 710 with the leg flange 709. A second side can include a release paper 711.

Removal of the release paper 711 can expose the adhesive on the second side of the tape 710 (e.g., for assembly within the head of wall assembly 100). The tape 710 can have a thickness 710*a*. The thickness 710*a* can be in the range listed above for the thickness 610*a* (e.g., approximately 0.125 inches).

The gasket profile 701 does not include an intumescent material and/or a foil material. Accordingly, the purpose of this gasket profile is not to provide fire sealing across the head of wall 700. Instead, it is just to provide sound sealing. The tape 710 can provide a continuous or nearly continuous seal between the header track 130 and the leg flange 709. This can provide a more consistent sound barrier than when mechanical fasteners are used to secure the profile to the header track. Moreover, the bubble gasket 703 can sag between mechanical fasteners. Accordingly, the tape 710 can enhance the seal of the bubble gasket 703 with the ceiling 120. The tape 710 can extend along an entire length of the gasket profile 701 to fully seal against the track 130 of the assembly 100. In other arrangements, the tape 710 can be interrupted along the length of the gasket profile 701. However, preferably, any gaps present are significantly smaller than the stud spacing of the associated stud wall (e.g., less than 8 inches, less than 6 inches or less than 4 inches).

Certain Terminology

Terms of orientation used herein, such as "top," "bottom," "proximal," "distal," "longitudinal," "lateral," and "end," are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular," "cylindrical," "semi-circular," or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees. Ranges given are inclusive of endpoints.

Summary

Several illustrative embodiments of head-of-wall assemblies and components such as sound-blocking and/or fire-blocking gasket profiles have been disclosed. Although this disclosure has been described in terms of certain illustrative embodiments and uses, other embodiments and other uses, including embodiments and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various embodiments. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination.

Any portion of any of the steps, processes, structures, and/or devices disclosed or illustrated in one embodiment or example in this disclosure can be combined or used with (or instead of) any other portion of any of the steps, processes, structures, and/or devices disclosed or illustrated in a different embodiment, flowchart, or example. The embodiments and examples described herein are not intended to be discrete and separate from each other. Combinations, variations, and some implementations of the disclosed features are within the scope of this disclosure.

While operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Additionally, the operations may be rearranged or reordered in some implementations. Also, the separation of various components in the implementations described above should not be understood as requiring such separation in all implementations, and it should be understood that the described components and systems can generally be integrated together in a single product or packaged into multiple products. Additionally, some implementations are within the scope of this disclosure.

Further, while illustrative embodiments have been described, any embodiments having equivalent elements, modifications, omissions, and/or combinations are also within the scope of this disclosure. Moreover, although certain aspects, advantages, and novel features are described herein, not necessarily all such advantages may be achieved in accordance with any particular embodiment. For example, some embodiments within the scope of this disclosure achieve one advantage, or a group of advantages, as taught herein without necessarily achieving other advantages taught or suggested herein. Further, some embodiments may achieve different advantages than those taught or suggested herein.

Some embodiments have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

For purposes of summarizing the disclosure, certain aspects, advantages and features of the inventions have been described herein. Not all, or any such advantages are necessarily achieved in accordance with any particular embodiment of the inventions disclosed herein. No aspects of this disclosure are essential or indispensable. In many embodiments, the devices, systems, and methods may be configured differently than illustrated in the figures or description herein. For example, various functionalities provided by the illustrated modules can be combined, rearranged, added, or deleted. In some embodiments, additional or different processors or modules may perform some or all of the functionalities described with reference to the example embodiment described and illustrated in the figures. Many implementation variations are possible. Any of the features, structures, steps, or processes disclosed in this specification can be included in any embodiment.

In summary, various embodiments and examples of head-of-wall assemblies and fire blocking tracks and related methods have been disclosed. This disclosure extends beyond the specifically disclosed embodiments and examples to other alternative embodiments and/or other uses of the embodiments, as well as to certain modifications and equivalents thereof. Moreover, this disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims.

What is claimed is:

1. A head-of-wall assembly, comprising:

a header track having a web and first and second flanges extending therefrom;

at least one stud coupled with the header track;

a wallboard coupled to the stud, an upper end of the wallboard overlapping the first flange of the header track;

a ceiling surface to which the header track is attached;

a gasket comprising a profile layer, the profile layer defining an air gap;

wherein the profile layer is coupled to the first flange of the header track by an adhesive tape and contacts the wallboard and the ceiling surface to provide a seal between the wallboard and the ceiling surface;

wherein the head-of-wall assembly is a dynamic assembly having a deflection gap, the deflection gap being variable between a closed position and an open position, the profile layer further comprising:

an upper flange, the upper flange slidingly engaged with the header track and at least partially defining the air gap;

wherein the upper flange is configured to fold towards a lower flange of the profile layer to collapse the air gap as the deflection gap narrows to the closed position.

2. The assembly of claim 1, wherein the adhesive tape is positioned on a planar surface of the lower flange of the profile layer.

3. The assembly of claim 2, wherein the adhesive tape is a foam tape.

4. The assembly of claim 2, wherein the planar surface of the profile layer is parallel with the upper flange.

5. The assembly of claim 1, further comprising a bubble gasket configured to sealingly engage the ceiling surface with the deflection gap in the open and closed positions.

6. The assembly of claim 1, wherein the profile layer comprises a vinyl material.

7. A fire-rated head-of-wall assembly, comprising:

a header track configured to be coupled to a ceiling surface, the header track having a web and first and second flanges extending from the web in a first direction, wherein each of the first and second flanges is substantially planar such that the header track defines a substantially U-shaped cross section;

at least one stud coupled with the header track, an upper end of the stud located between the first and second flanges;

a wallboard coupled to the stud, an upper end of the wallboard overlapping the first flange of the header track;

a deflection gap formed between the upper end of the wallboard and the ceiling surface, the deflection gap being variable between a closed position and an open position;

a fire-blocking gasket comprising:

a first layer comprising a vinyl profile, the vinyl profile having a vertical portion and a horizontal portion at least partially defining an air gap, the horizontal portion including an upper flange;

a second layer comprising an intumescent material; and an adhesive tape positioned on a side of the vertical portion of the vinyl profile and configured to secure the fire-blocking gasket to the first flange of the header track;

wherein the vertical portion of the vinyl profile is positioned between the first flange and the wallboard, the upper flange contacts the ceiling surface and is positioned at least partially within the deflection gap in the open position, the upper flange slidingly engages with the first flange of the header track, and the upper flange and the horizontal portion fold towards the vertical portion of the first layer and collapse the air gap as the deflection gap narrows towards the closed position;

wherein the vinyl profile is configured to at least partially melt and the intumescent material is configured to at least partially expand to seal the deflection gap above a first temperature.

8. The assembly of claim 7, wherein the adhesive tape is positioned on a planar surface of the vertical portion.

9. The assembly of claim 8, wherein the adhesive tape is a foam tape.

10. The assembly of claim 7, the first layer further comprising:

a bubble configured to engage the ceiling surface with the deflection gap in the open and closed positions.

11. The assembly of claim 7, wherein the fire-blocking gasket further comprises a second layer comprising a foil lining.

12. The assembly of claim 11, wherein a melting temperature of the foil lining is greater than a melting temperature of the vinyl profile and an expansion temperature of the intumescent material is greater than the melting temperature of the vinyl profile.

13. A fire-rated head-of-wall assembly, comprising:

a header track having a web and first and second flanges extending therefrom, the header track coupled with a ceiling surface;

at least one stud coupled with the header track;

a wallboard coupled to the stud, an upper end of the wallboard overlapping the first flange of the header track;

a deflection gap formed between the upper end of the wallboard and the ceiling surface, the deflection gap being variable between a closed position and an open position;

a fire-blocking gasket comprising:

a first layer comprising a profile including an upper flange, the upper flange slidingly engaged with the header track and at least partially defining an air gap;

a second layer comprising an intumescent material; and an adhesive tape positioned on a side of a lower flange of the profile and configured to secure the fire-blocking gasket to the first flange of the header track;

wherein the upper flange contacts the ceiling surface to provide a seal across the deflection gap; and wherein the upper flange is configured to fold towards a vertical portion of the profile to collapse the air gap as the deflection gap transitions towards the closed position.

14. The assembly of claim 13, the first layer further comprising a bubble configured to sealingly engage the ceiling surface in the open and closed positions.

15. The assembly of claim 13, wherein the fire-blocking gasket further comprises a third layer comprising a foil lining.

16. The assembly of claim 15, wherein the profile is configured at least partially melt, the intumescent material is configured to at least partially expand to seal the deflection gap, and the foil lining is configured to at least partially support the profile within the deflection gap as the intumescent material expands to seal the deflection gap above a first temperature.

17. The assembly of claim 15, wherein the third layer at least partially lines the air gap, and the second layer is coupled to the third layer and positioned within the air gap.

18. The assembly of claim 17, wherein a melting temperature of the foil lining is greater than a melting temperature of the profile.

19. The assembly of claim 17, wherein the profile comprises a vinyl material.

20. The assembly of claim 17, wherein the profile comprises a polymer material.

21. The assembly of claim 17, wherein foil lining comprises aluminum.

22. The assembly of claim 13, wherein adhesive tape is a foam tape.

* * * * *